US006691775B2

(12) United States Patent
Headworth

(10) Patent No.: US 6,691,775 B2
(45) **Date of Patent: *Feb. 17, 2004**

(54) SYSTEM FOR ACCESSING OIL WELLS WITH COMPLIANT GUIDE AND COILED TUBING

(76) Inventor: Colin Stuart Headworth, 2312 Wordsworth, Houston, TX (US) 77030-2028

( * ) Notice: Subject to any disclaimer, the term of this patent is extended or adjusted under 35 U.S.C. 154(b) by 0 days.

This patent is subject to a terminal disclaimer.

(21) Appl. No.: 10/003,859

(22) Filed: Oct. 24, 2001

(65) Prior Publication Data

US 2002/0074135 A1 Jun. 20, 2002

Related U.S. Application Data

(62) Division of application No. 09/444,598, filed on Nov. 22, 1999, now Pat. No. 6,386,290.
(60) Provisional application No. 60/116,324, filed on Jan. 19, 1999.

(51) Int. Cl.[7] ..... E21B 19/22
(52) U.S. Cl. ..... 166/77.2; 166/77.3; 166/349; 166/342
(58) Field of Search ..... 166/77.2, 77.1, 166/77.3, 77.4, 77.51, 77.52, 77.53, 85.4, 367, 368, 359, 351, 349, 346, 342

(56) References Cited

U.S. PATENT DOCUMENTS

| | | | | |
|---|---|---|---|---|
| 3,401,749 A | | 9/1968 | Daniel | 166/46 |
| 4,033,045 A | | 7/1977 | Wing | 33/275 G |
| 4,046,191 A | * | 9/1977 | Neath | 166/361 |
| 4,091,867 A | | 5/1978 | Shannon, Jr. et al. | 166/77 |
| 4,134,453 A | | 1/1979 | Love et al. | 166/298 |
| 4,176,986 A | | 12/1979 | Taft et al. | 405/211 |
| 4,182,584 A | | 1/1980 | Panicker et al. | 405/203 |
| 4,225,270 A | | 9/1980 | Dareing | 405/168 |
| 4,265,304 A | | 5/1981 | Baugh | 166/77 |
| 4,266,886 A | | 5/1981 | Milton | 405/169 |
| 4,281,716 A | | 8/1981 | Hall | 166/339 |
| 4,391,332 A | | 7/1983 | Fayren | 166/350 |
| 4,423,983 A | | 1/1984 | Dadiras et al. | 405/195 |
| 4,470,722 A | | 9/1984 | Gregory | 405/195 |
| 4,544,036 A | | 10/1985 | Saliger | 166/341 |
| 4,556,340 A | | 12/1985 | Morton | 405/195 |

(List continued on next page.)

FOREIGN PATENT DOCUMENTS

| | | | |
|---|---|---|---|
| WO | WO 97/40255 | 10/1997 | E21B/19/22 |

OTHER PUBLICATIONS

PCT Notification of Transmittal Of The International Search Report or the Declaration.

PCT International Search Report.

*Primary Examiner*—Frederick L. Lagman
(74) *Attorney, Agent, or Firm*—Robert W. Strozier; Alan H. Gordon

(57) ABSTRACT

The disclosure describes a spoolable compliant guide, a system including a spoolable compliant guide and injector and methods for using the compliant guide, where the guide is designed to connect at one end to the injector and at its other end to a remote installation having a seal and to allow coiled tubing to be inserted into the installation through the seal. Because the guide permits a substantial distance to exist between the injector and the installation seal and functions as a crimp or band resistor for the coiled tubing, the guide enables the injector to be conveniently positioned remote from the installation such as a wellhead and assumes a compliant shape between the injector and the installation allowing dynamic relative movement between them without the use of heave compensators. Thus, for subsea installations, the injector, its control system and coiled tubing reels can all be located on the water's surface for ease of access and maintenance.

31 Claims, 13 Drawing Sheets

U.S. PATENT DOCUMENTS

| | | | | | |
|---|---|---|---|---|---|
| 4,570,716 | A | | 2/1986 | Genini et al. | 166/346 |
| 4,621,403 | A | | 11/1986 | Babb et al. | 29/433 |
| 4,730,677 | A | | 3/1988 | Pearce et al. | 166/345 |
| 4,743,175 | A | | 5/1988 | Gilmore | 417/361 |
| 4,825,953 | A | | 5/1989 | Wong et al. | 166/338 |
| 4,899,823 | A | | 2/1990 | Cobb et al. | 166/351 |
| 4,903,774 | A | * | 2/1990 | Dykes et al. | 166/363 |
| 4,940,095 | A | | 7/1990 | Newman | 166/378 |
| 4,993,492 | A | | 2/1991 | Cressey et al. | 166/339 |
| 5,007,482 | A | | 4/1991 | Forsyth et al. | 166/345 |
| 5,088,559 | A | * | 2/1992 | Taliaferro | 166/77.2 |
| 5,244,046 | A | | 9/1993 | Council et al. | 166/380 |
| 5,279,364 | A | | 1/1994 | Jantzen et al. | 166/77 |
| 5,360,075 | A | | 11/1994 | Gray | 175/61 |
| 5,507,349 | A | * | 4/1996 | Wray et al. | 166/77.2 |
| 5,553,668 | A | * | 9/1996 | Council et al. | 166/77.3 |
| 5,671,811 | A | | 9/1997 | Head | 166/346 |
| 5,735,351 | A | | 4/1998 | Helms | 166/384 |
| 5,749,676 | A | | 5/1998 | Head | 405/171 |
| 5,803,168 | A | | 9/1998 | Lormand et al. | 166/77.2 |
| 5,832,998 | A | | 11/1998 | Decker et al. | 166/185 |
| 5,848,641 | A | | 12/1998 | Epp | 166/77.2 |
| 5,960,885 | A | * | 10/1999 | Edwards et al. | 166/77.2 |
| 5,975,203 | A | * | 11/1999 | Payne et al. | 166/77.3 |
| 5,996,689 | A | * | 12/1999 | Head | 166/77.2 |
| 6,006,839 | A | | 12/1999 | Dearing et al. | 166/384 |
| 6,015,015 | A | * | 1/2000 | Luft et al. | 166/77.2 |
| RE36,556 | E | | 2/2000 | Smith et al. | 175/45 |
| 6,032,744 | A | | 3/2000 | Burge et al. | 166/385 |
| 6,042,303 | A | | 3/2000 | Head | 405/195.1 |
| RE36,723 | E | | 6/2000 | Moore et al. | 166/242.2 |
| 6,082,454 | A | | 7/2000 | Tubel | 166/250 |
| 6,102,125 | A | | 8/2000 | Calder | 166/359 |
| 6,116,345 | A | | 9/2000 | Fontana et al. | 166/343 |
| 6,276,454 | B1 | * | 8/2001 | Fontana et al. | 166/77.3 |
| 6,347,664 | B1 | * | 2/2002 | Perio, Jr. | 166/77.3 |
| 6,386,290 | B1 | * | 5/2002 | Headworth | 166/77.3 |

* cited by examiner

SYSTEM FOR ACCESSING OIL WELLS WITH COMPLIANT GUIDE AND COILED TUBING

CROSS REFERENCE TO RELATED APPLICATIONS

This application is a divisional of U.S. patent application Ser. No. 09/444,598 filed Nov. 22, 1999 now U.S. Pat. No. 6,386,290 which claims provisional priority to U.S. Provisional Application Ser. No. 60/116,324 filed Jan. 19, 1999.

BACKGROUND OF THE INVENTION

1. Field of the Invention

This invention relates to a compliant guide for accessing seabed installations such as sea-based oil or gas wells, systems using the guides, methods for dispensing coiled tubing with the compliant guide to such installation and methods for making and using same.

More particularly, this invention relates to a system for accessing seabed installations including a compliant guide for coiled tubing, flexible shafts or other similar apparatus. The compliant guide attaches at its first end to an injector apparatus and at its second end to a seabed installation providing a guide conduit for coiled tubing or other apparatus to feed same to the seabed installation. This invention also relates to methods for making the guide and systems and methods for using the guide and system.

2. Description of the Related Art

When inserted into an oil well, coiled tubing has a wide variety of uses such as drilling, logging and production enhancement according to known art. Coiled tubing can be withdrawn from a well immediately following a well treatment, or it can be permanently left in the well as part of the well completion. When coiled tubing is used, it is necessary to provide an annular well seal where the coil tubing enters the well. This seal is sometimes referred to as the "stuffing box" or "stripper", and its function is to provide a dynamic, pressure tight seal around the coiled tubing to prevent leakage of the well fluids from the oil well at the point where the coiled tubing enters the oil well. Prior art methods and apparatus have positioned the annular well seal close to the injector, typically only a few inches away, for the primary purpose of avoiding buckling failure of the coiled tubing between the injector and the annular well seal.

According to the prior art, oil wells on land require a lubricator. This is a device that can be many tens of feet tall and is temporarily attached to the wellhead or tree of the well. The injector must be held in place above this lubricator, close to the annular well seal. Substantial cranage or support structure is required to lift and hold the injector in place. Providing such cranage or structures adds to the cost, complexity, and duration of coiled tubing operations.

According to the prior art, underwater oil wells with surface wellheads are similar to land oil wells in that they require that the injector be lifted and held in place above the lubricator and close to the annular well seal. An additional disadvantage is that the injector must be lifted from a floating vessel onto the facility that has the surface wellheads. Many off-shore platforms do not have installed cranes adequate for this task, and the cost of temporarily providing such cranes may preclude the economical use of coiled tubing altogether.

According to the prior art, coiled tubing may be used in the case of underwater oil wells with temporary surface wellheads. In some instances a drilling vessel is connected to the underwater oil well with a temporary riser. This would occur during the drilling phase of an underwater oil well. A lubricator is sometimes attached to the temporary surface wellhead, and in such instances the injector must be transferred from a floating vessel, lifted and held above the lubricator close to the annular well seal. Since the drilling vessel floats freely without mooring, the injector must be heave compensated.

Underwater oil wells, with subsea wellheads which do not have any type of platform structure on the surface above the well, are generally accessed from a drill ship or semi-submersible drilling type vessel. According to the prior art, coiled tubing access from such vessels requires that the pressurized well bore to be temporarily extended by use of a tensioned rigid riser from the wellhead to the vessel and associated large heave compensation and riser handling equipment. This then allows the annular well seal to be close to the injector. Examplary of such prior art are U.S. Pat. No. 4,423,983 which discloses a fixed or rigid marine riser extending from a subsea facility to a floating structure located substantially directly above; and U.S. Pat. No. 4,470,722 which discloses a marine production riser for use between a subsea facility (production manifold, wellhead, etc.) and a semi-submersible production vessel. Other related prior art includes U.S. Pat. No. 4,176,986 which discloses a rigid marine drilling riser with variable buoyancy cans. Drill ships or semi-submersible drilling type vessels and associated equipment required for tensioned rigid risers have a high daily cost. For example, routine coiled tubing access performed on a subsea well may have a substantial daily cost in excess of one hundred thousand dollars per day.

U.S. Pat. No. 4,405,016 invented by Michael J. A. Best discloses a typical subsea wellhead and Christmas tree. This patent also teaches equipment and methods for removal of the tree cap to gain vertical access to the well bore below the wellhead for maintenance and servicing of the well bore. U.S. Pat. No. 4,544,036 invented by Kenneth C. Saliger discloses a subsea wellhead, Christmas tree, and associated equipment to allow connecting a production flow line to the Christmas tree. U.S. Pat. No. 4,423,983 invented by Nickiforos G. Dadiras et al discloses a fixed or rigid marine riser extending from a subsea facility to a floating structure located substantially directly above. U.S. Pat. No. 4,470,722 invented by Edward W. Gregory discloses a marine production riser for use between a subsea facility (production manifold, wellhead, etc.) and a semi-submersible production vessel. U.S. Pat. No. 4,176,986 invented by Daniel G. Taft et al discloses a rigid marine drilling riser with variable buoyancy cans. U.S. Pat. No. 4,556,340 to Arthur W. Morton and U.S. Pat. No.4,570,716 to Maurice Genini et al disclose the use of flexible risers or conduits between a subsea facility and a floating production facility. U.S. Pat. No. 4,281,716 to Johnce E. Hall discloses a flexible riser to allow vertical access to a subsea well to perform wireline maintenance therein. U.S. Pat. No. 4,730,677 invented by Joseph L. Pearce et al discloses a method and system for servicing subsea wells with a flexible riser. U.S. Pat. No. 4,993,492 invented by John F. Cressey et al discloses a method of inserting wireline equipment into a subsea well using a subsea wireline lubricator. U.S. Pat. No. 4,825,953 invented by Kwok-Ping Wong discloses a wireline well servicing system for underwater wells using a subsea lubricator. U.S. Pat. No. 4,899,823 invented by Charles C. Cobb et al discloses a method and apparatus for running coiled tubing in subsea wells.

In an effort to preclude the need for tensioned rigid risers and riser heave compensation systems, prior art that uses flexible risers in place of rigid risers has been disclosed. Examplary of such prior art are U.S. Pat. No. 4,556,340 and U.S. Pat. No. 4,570,716 that disclose the use of flexible risers or conduits between a subsea facility and a floating production facility; and U.S. Pat. No. 4,281,716 that discloses a flexible riser to facilitate vertical access to a subsea well to perform wireline maintenance. Other related prior art includes U.S. Pat. No. 4,730,677 that discloses a method and system for servicing subsea wells with a flexible riser and U.S. Pat. No. 5,671,811 that discloses a tube assembly for servicing a subsea wellhead by injecting an inner continuous coiled tubing into an outer continuous coiled tubing. What this prior art has in common is the extension of the pressurised well bore from the wellhead to the floating facility to allow the annular well seal, for either wireline or coiled tubing, to be above the water surface or close to the injector.

Damage, failure or emergency disconnection of a riser connected between a subsea wellhead and a floating vessel, or of tubing between a facility with surface wellheads and a floating vessel, can create safety hazards and a pollution risk if there are pressurised well fluids inside the riser or tubing. These risk factors are of significant concern and are often cited as the reason for not carrying out a particular oilfield operation. These concerns are heightened if the floating vessel is maintained in position by means of dynamic positioning instead of anchors. Such a vessel can accidentally move off station and reach the geometric or structural limit of the riser very quickly, within a few tens of seconds, depending on the water depth. Concerns about fatigue failure also arise if this riser or tubing is a homogeneous steel structure that is subjected to both pressure and varying stresses due to the relative motion between the wellhead and floating vessel and due to environmental forces.

Prior art methods and systems for accessing subsea wells with wireline exist which do not use risers to temporarily extend a pressurised well bore up to a floating vessel. Instead, a subsea lubricator may be used which connects directly onto a subsea tree or wellhead. A subsea lubricator is a free standing structure on a subsea tree. It is generally 50 ft. to 100 ft. tall with an annular well seal at the top that allows a wireline to enter from ambient pressure into a lubricator that is at well pressure. The top of a subsea lubricator remains underwater at a sufficient depth to allow for at least the draft of a floating support vessel which holds a wireline winch and ancillary support equipment. Subsea lubricators can be dispatched from vessels that are not drill ships or semi-submersible drilling type vessels and thus provide the flexibility to use vessels with a lower daily cost and other advantageous attributes such as rapid mobilization time offered by dynamically positioned vessels. Exemplary of this prior art are U.S. Pat. No. 4,993,492 that discloses a method of inserting wireline equipment into a subsea well using a subsea wireline lubricator; and U.S. Pat. No. 4,825,953 that discloses a wireline well servicing system for under water wells using a subsea lubricator. The range of tasks that can be accomplished in a well by use of wireline alone is greatly increased by using coiled tubing together with wireline.

One prior art method disclosed in U.S. Pat. No. 4,899,823 holds the injector in place above a subsea lubricator that is connected to a subsea wellhead. The injector is positioned underwater to place it in close proximity to the annular well seal. A disadvantage of this approach is that since the injector is large and heavy, only relatively short subsea lubricators can be used. Otherwise, excessive bending moments can be applied to the subsea wellhead in the event of waves, currents or other forces acting on the injector. A relatively short lubricator limits the scope of downhole coiled tubing operations to ones that can be accomplished with only relatively short toolstrings.

Thus, it would represent an advancement in the art to provide a system for inserting coiled tubing into an oil well using an injector that is remote from the annular well seal. Providing an apparatus that increases the distance between the injector and the annular well seal from a few inches to up to hundreds or thousands of feet makes possible a range of new methods and systems for inserting coiled tubing, into a variety of oil wells, which were either too risky or impractical up to now. Oil wells on land, underwater oil wells with subsea wellheads, underwater oil wells with surface wellheads, oil wells on offshore platforms and oil wells still in the drilling phase can all benefit from the apparatus, methods and systems having remote coiled tubing injector capabilities.

SUMMARY OF THE INVENTION

The present invention provides a system designed to substantially increase the distance between an injector for coiled tubing or similar flexible material or apparatus and an oil well or other similar installation. In the case of pressurized installations such as an oil or gas well on the seabed, the system of the present invention can include a pressure seal associated with a distal end of the apparatus, while in the case of installations where the well bore is extended using a production riser to a site remote from the seabed such as the surface, the apparatus can include a pressure seal at the point of entry into the riser.

The present invention includes a spoolable compliant guide (sometimes "SCG") comprising a hollow, continuous or jointed tube having a first end for detachably engaging an installation and a second end for detactably engaging an installation servicing apparatus. Preferably the SCG is capable of withstanding tension and compression forces in excess of about 50,000 lbs. and spoolable onto a reel for ease of transport and speed of deployment and recovery.

The SCG is sufficiently long to assume a compliant shape between an injector and an installation such as a lubricator attached to a undersea wellhead. The compliant shape facilitates dynamic bending enabling relative movement between the injector and lubricator and avoiding the need for heave compensation of either the SCG itself or the injector. A desired compliant shape can be obtained through the use of bend restrictors, buoyant members, weights and/or ballasting members attached to the SCG and positioned along its length. Because the SCG can dynamically bend, vessels incorporating riser tensioning and heave compensation systems are not required for subsea wellhead operations.

The SCG can be provided with an internal anti-friction device to reduce or minimize tension and compression of the coiled tubing between the injector and the annular well seal.

The SCG can also include an emergency disconnect and a coiled tubing cutter between the annular well seal and the injector so that the SCG with the coiled tubing therein can be relatively instantly disconnected from the lubricator leaving the annular well seal connected to the lubricator.

If desired, the annulus between the coiled tubing and the SCG can be filled with a pressurized lubricating medium by incorporating a second annular seal at the injector end of the spoolable compliant SCG.

The SCG also includes an annular seal against well pressure and well fluids at the lubricator end and does not have well fluids inside thereby reducing or minimizing the consequences of failure or damage compared to tubing which does contain pressurized well fluids. Therefore, the SCG can be used without regard to the containment of pressure or well fluids. Because the annular well seal of the SCG is at the lubricator, a subsea lubricator system can be used for accessing subsea wells with coiled tubing while the injector remains on the floating vessel.

The SCG can also include an outer and inner tube with an annular space there between and orifices for circulating a fluid through the annular space. The SCG can also include dynamic force sensors coupled to dynamic force compensation apparatus positioned along the length of the SCG for countering lateral forces (i.e., applying an equal and opposite force at a selected position or positions) when the SCG is connected to the installation. The SCG can also include dynamic force sensors positioned along the length of the SCG, but especially at the wellhead end of the SCG, coupled to a dynamic repositioning apparatus associated with a vessel for countering lateral forces acting on the well head (i.e., moving the vessel so as to apply an equal and opposite force) when the SCG is connected to the installation.

The present invention also provides a system including an SCG, coiled tubing or similar apparatus, a lubricator and an injector facility including an injector, a guide spool, a coiled tubing spool and associated equipment to operate the injector and spools. The system facilitates vertical access to a deep oil well and insertion of the coiled tubing or a similar material or apparatus therein to. The system may include a blowout preventer, lubricator section, wellhead connector and a guide connector for attaching to the SCG. One end of a the SCG apparatus is detachably connected to a lubricator guide connector and the other end is detachably connected to the injector facility, near to an injector. The injector facility can be a vehicle, a floating vessel, a drilling rig or other suitable facility.

The system can also include a coiled tubing tool which can be connected to an end of the coiled tubing as it emerges from the lubricator end of the SCG, but prior to the SCG's attachment to the lubricator. Alternatively, if the internal diameter and curvature of the SCG allows, then the coiled tubing tool can also be connected to the coiled tubing prior to insertion into the SCG. The toolstring (coiled tubing tool and coiled tubing) is designed to enter the lubricator prior to the SCG's being detachably connected to the lubricator.

The present invention further includes a method for accessing an installation with a compliant SCG, where the method includes detachably connecting one end of a SCG to the installation and the other end of the SCG to a distant facility. A flexible apparatus can then be fed through the SCG into the installation. Finally, the method includes detaching the SCG.

The present invention further includes a method for inserting coiled tubing or other flexible continuous or jointed conduit or apparatus into a wellhead, where the method includes attaching a lubricator to a wellhead; detachably connecting one end of a SCG to the lubricator and the other end to an injector facility. The injector facility may include an injector, a guide spool, a coiled tubing spool and associated control apparatus. The coiled tubing is then introduced into the SCG by means of the injector's unreeling the tubing from its storage reel or spool, urging the coiled tubing through the injector and then into and through the SCG. The method may include connecting a coiled tubing tool to the coiled tubing once it has emerged from the lubricator end of the SCG and before the SCG is attached to the lubricator. Alternatively, if the internal diameter and curvature of the SCG allows, then the coiled tubing tool can be connected to the coiled tubing prior to insertion into the SCG. The coiled tubing with the tool connected thereto (the toolstring) is then introduced directly into the lubricator. The toolstring is then inserted into the oil well through the injector. The above processes can be reversed to retrieve all of the items from the oil well.

The present invention also provides an SCG for guiding coiled tubing into a riser comprising a hollow, continuous or jointed tube having a first end detachably connected to a riser for an installation such as an oil or gas well and a second end for detachably engageable with an installation servicing apparatus. Preferably, the SCG is capable of withstanding tension and compression forces in excess of about 50,000 lbs. and spoolable onto a reel for ease of transport and speed of deployment and recovery.

The present invention also provides a coiled tubing system for use with risers. This system comprises a string of coiled tubing, a coiled tubing injector cooperable with a well bore seal and an SCG, a hollow, continuous or jointed tube including a first end having an optional connector for detachably engaging an installation such as an oil or gas well located at a proximal end of a riser and a second end for detachably engaging the injector. The SCG with the coiled tubing inside extends from a proximal end of the riser to the wellhead at the distal end of the riser. This system is especially well-suited for risers made of unbonded flexible pipe, where the SCG is reactively coupled to the coiled tubing. Because the SCG is reactive with the coiled tubing, the SCG accommodates the compressive forces associated with coiled tube operations, especially extraction, without damage to the unbonded flexible pipe.

The present invention also provides methods for performing coiled tubing operations through a riser, especially an unbonded flexible riser, without damage to the riser due to compressive forces that are generally encountered during coiled tubing extraction. The method includes inserting coiled tubing into an SCG of the present invention, inserting the combined structure through a proximal or surface end of the riser until a working end of the coiled tubing contacts the wellhead, injecting the combined structure into the wellhead and removing the combined structure from the riser upon completion of a coiled tubing operation.

DESCRIPTION OF THE DRAWINGS

The invention can be better understood with reference to the following detailed description together with the appended illustrative drawings in which like elements are numbered the same:

FIG. 1 illustrates part of a floating vessel that has guide wires connected to a subsea wellhead or tree;

FIG. 2 illustrates a bottom stack assembly of a subsea lubricator and a control umbilical being lowered by lift wire, to mate with a wellhead, from a floating vessel;

FIG. 3 illustrates a top lubricator assembly of a subsea lubricator being lowered by lift wire, to mate with a bottom stack assembly of a subsea lubricator, from a floating vessel;

FIG. 4 illustrates a spoolable compliant guide sometime ("SCG") assembly, coiled tubing and a coiled tubing toolstring being lowered from a floating vessel using two injectors in series, guided by a remote operated vehicle, to mate with a subsea lubricator;

FIG. 5 illustrates the SCG and coiled tubing system connected to a subsea lubricator and wellhead with the SCG in its compliant mode ready for downhole coiled tubing operations;

TABLE OF ELEMENTS AND NUMERICAL REFERENCES

Figure 1:
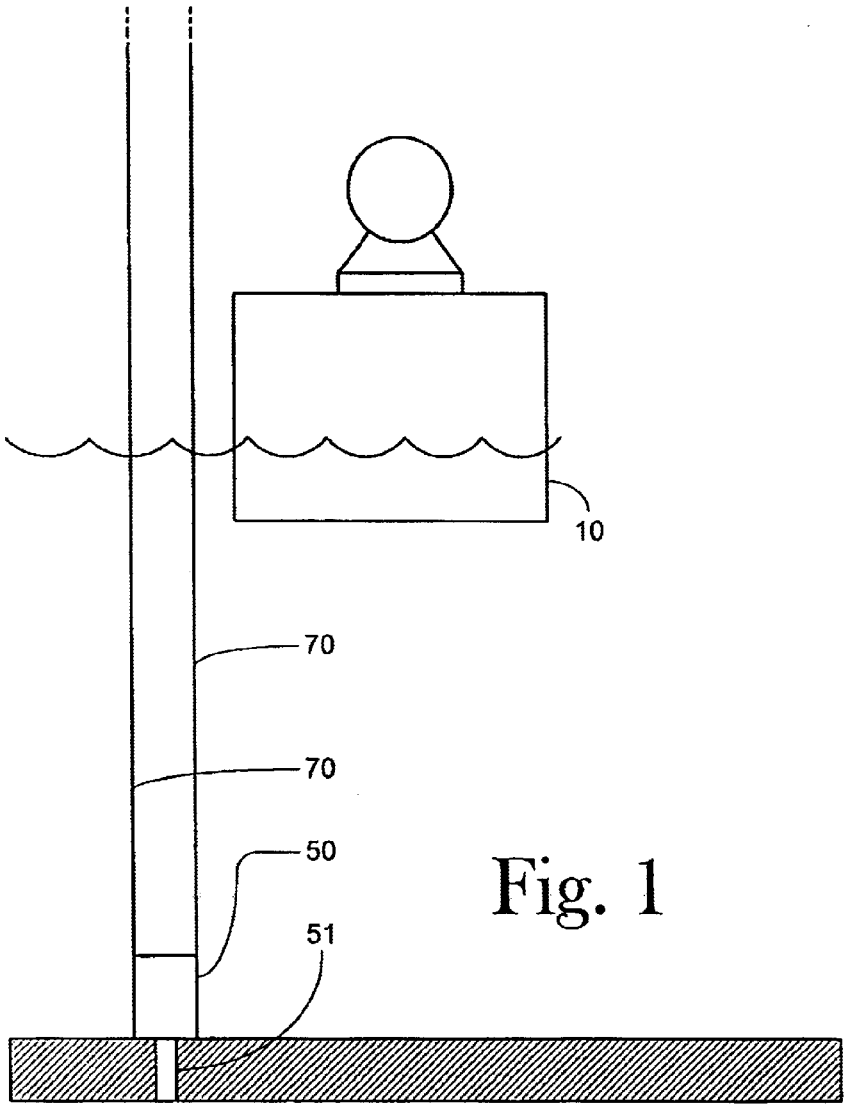
FIGS. 1 to 5 are intended to show a sequence of operations.

| | |
|---|---|
| 10 | floating vessel |
| 20 | reel |
| 21 | coiled tubing |
| 22 | first injector |
| 23 | second injector |
| 24 | coiled tubing toolstring |
| 30 | spoolable compliant guide |
| 31 | hang-off flange |
| 32 | main body |
| 33 | emergency disconnect means |
| 34 | coiled tubing cutting means |
| 35 | annular well seal (coiled tubing) |
| 36 | latching means |
| 37 | buoyant block |
| 38 | bend restrictor |
| 39 | bend restrictor |
| 40 | subsea lubricator |
| 41 | control umbilical |
| 42 | top lubricator assembly |
| 43 | bottom stack assembly |
| 50 | wellhead |
| 51 | well |
| 60 | remote operated vehicle (ROV) |
| 70 | guidewire |
| 71 | lift wire |
| 80 | anti-friction assembly |
| 81 | spacer tube |
| 82 | linear bearing |

DETAILED DESCRIPTION OF THE INVENTION

The inventor has found that a system for injecting coiled tubing into oil wells can be constructed using a spoolable compliant guide sometimes ("SCG") that avoids the need to lift and hold a coiled tubing injector vertically above a lubricator or subsea lubricator close to the annular well seal thereby substantially reducing the cost required to access oil wells with coiled tubing. This invention can minimize risks from damage, failure or emergency disconnection by avoiding the use of a riser or similar tubing that extends the pressurized well bore up to the support vessel or vehicle. The present invention provides a conduit for coiled tubing extending the capability of subsea lubricator methods and systems to include coiled tubing in addition to wireline. This invention can also provide a coiled tubing insertion system that does not require heave compensation. This invention also provides a system for performing coiled tubing operations through a riser and especially through a riser that has limited tolerance to compression such as an unbonded flexible riser.

The present invention, broadly, relates to a SCG including a flexible hollow structure such as tubing, a first end having an optional connector and a second end having a connector where the SCG is designed to be detachably connected at its first end to an installation service facility and optionally at its second end to a remote installation. The installations include any installation where remote servicing or operations can to be performed by accessing the installation through the hollow SCG. Preferred installations include oil and gas wells, geothermal wells or similar installations.

The present invention also relates to a system including an installation service facility having an SCG spooled onto a spool comprising a flexible, hollow conduit including a first end having a first end connector and a second end having a second end connector, an apparatus for directing the first end of the SCG to an installation so that the SCG can be connected to the installation and associated equipment to spool or unspool the SCG and to operate a remote operated vehicle, where the installation can be accessed through the SCG.

The present invention is also directed to a coiled tubing delivery system including an installation service facility having an SCG comprising a flexible, hollow conduit including a first end having a first end connector and a second end having a second end connector spooled onto a SCG spool or reel, an apparatus for directing the first end of the SCG to an installation so that the SCG can be connected to the installation, coiled tubing spooled onto a coiled tubing spool or reel, a coiled tubing injector connected to the SCG at its second end for injecting the coiled tubing into the SCG, and associated equipment to spool or unspool the SCG and the coiled tubing and to operate a remote operated vehicle, where the installation can be accessed through the SCG.

The present invention broadly relates to methods associated with the use of an SCG for accessing remote installations especially offshore or subsea oil wells. The method includes connecting a first end having a first end connector of an SCG to a receiving connector associated with a wellhead of an oil well and inserting an apparatus into and through the SCG to the well head.

This invention also relates to a method for inserting coiled tubing into a bore of a well including connecting a first end having a first end connector of an SCG to a receiving connector associated with a wellhead of the well, inserting coiled tubing into a second end of the SCG and through the SCG, and inserting the coiled tubing into the bore of the well through the wellhead. Generally, the insert into the wellhead occurs through a lubricator or subsea lubricator for offshore submerged wells.

Subsea lubricators are a prior art, well intervention system designed to safely access an underwater, pressurized oil or gas well with a toolstring on the end of wireline. The wireline is generally manipulated by a wireline winch on a floating vessel as is well-known in the art. A subsea lubricator prevents leakage of well fluids at the point where the wireline enters the lubricator by means of a dynamic, annular well seal around the wireline. In addition to providing a means for introducing a conduit or equipment into a wellhead, a lubricator can also including various other devices for pressure control in both normal and emergency operational modes, all of which can be configured in different ways. A variety of possible configurations of a subsea lubricator for a wireline well intervention are well-known in the art. The advantage of subsea lubricators is that vessels other than drilling vessels can be used for well access because a tensioned riser, which communicates the well fluids from the wellhead to the surface, is not requited.

Prior to this invention, subsea lubricators had been used primarily for underwater wireline operations in wells. The present invention is directed to a way in which a subsea lubricator can be used to support underwater coiled tubing operations in wells or to other well operations requiring access via a hollow compliant conduit. The ability to use coiled tubing greatly increases the types of operations that can be carried out in an oil or gas well because the hollow bore can be used to pump fluids with signal and power conductors inserted. In addition, coiled tubing can withstand compression forces allowing it to be pushed into regions of wells that cannot be reached using gravity dependent wireline methods.

A wireline is fully exposed to seawater between the floating vessel and the subsea lubricator and is not contained in a riser. The wireline is run into the well with gravity acting on the weight of the wireline and with a weighted toolstring connected at its bottom end. The weight of the wireline and toolstring are sufficient to overcome the extrusion forces caused by the pressure in the well at the wireline annular well seal at the top of the subsea lubricator. During well intervention operations, the wireline is either in tension or slack.

Unlike wirelines, the weight of coiled tubing and a weighted toolstring is usually insufficient to overcome the extrusion forces, thus, making impractical the use of coiled tubing in wells via simple gravity motivated access. Therefore, an injector is commonly used to push the coiled tubing into the well until there is a sufficient combined weight of coiled tubing and toolstring in the well to enable gravity to provide the motive force. It follows that coiled tubing experiences not only tension but, unlike a wireline, it also experiences compression between the injector and the annular well seal. Because coiled tubing is generally relatively slender, the distance between the injector and the annular well seal is relatively short, usually a few inches, to avoid buckling due to the action of the compression forces. Thus, the prior art methods require that a riser be provided between the well and the floating vessel. This riser contains the pressurized well fluids and results in having the annular well seal close to the injector.

In distinction from the prior art, this invention enables the annular well seal to be many hundreds or thousands of feet from the injector without the need of a riser interposed between the subsea lubricator and the floating vessel. Instead of a riser, a SCG is used which is tubular and has a sufficiently close tolerance fit around the coiled tubing to prevent the coiled tubing from buckling at the level of compression loads required to overcome the extrusion and friction forces at the annular well seal. Because there are no pressurized well fluids inside the SCG, the SCG construction does not have to resist the well pressures or to seal against leakage of well fluids.

An apparent disadvantage of the SCG is that its inside diameter is likely to be close in size to the outside diameter of the coiled tubing it will guide. Generally, coiled tubing is used with a variety of tools attached to the end of coiled tubing for performing a wide range of tasks, and these toolstrings typically have a larger diameter than the coiled tubing itself and often larger than the i.d. of the SCG. Therefore, it is not normally possible to run the coiled tubing with the coiled tubing toolstring attached through the SCG as in the case of riser systems according to the prior art. However, large diameter SCGs can be constructed to accommodate coiled tubing with the toolstring attached.

This disadvantage can be overcome by connecting the coiled tubing toolstring to coiled tubing after the coiled tubing has been inserted all the way through the SCG. One approach is to pre-insert the coiled tubing into the SCG and reel the combined structure on and off a single reel. The SCG along with the pre-inserted coiled tubing with the attached coiled tubing toolstring can then be quickly lowered down to and recovered up from the subsea lubricator simply using a single reel, an injector and methods similar to those for handling well intervention coiled tubing operations, known to those skilled in the art, where an injector grips and moves coiled tubing, and the reel simply stores the coiled tubing. When using two injectors in series, the injectors grip and move the SCG until the SCG with the pre-inserted coiled tubing has passed completely through the injectors until the injectors are able to grip the coiled tubing which extends out of the SCG. Once the subsea lubricator end of the SCG, with pre-inserted coiled tubing, has been unreeled from the storage reel and passed through both injectors, the coiled tubing toolstring can be attached to the coiled tubing prior to lowering the assembly down to the subsea lubricator.

Because the SCG of the present invention is designed to attach to installations such as oil wells and provide remote entry thereto with devices such as coiled tubing, the equipment attached to the top of the wellhead such as a lubricator will be subject to tension and lateral forces. The wellhead, lubricator and well bore are designed for relatively high levels of tension, but are not designed for relatively high levels of lateral forces, especially when those forces are enhanced due to environmental and other forces acting on the SCG. Such environmental forces are often present in subsea installations where the SCG many traverse hundreds to thousands of feet of sea with different currents of different velocities and directions at different depths. Additionally, the vessel to which the other end of the SCG is attached can move relative to the fixed subsea installation. All of these factors act to produce high lateral forces on the lubricator and wellhead.

To address these lateral forces, the inventor has found that by attaching a lateral force compensation system to the subsea end of the SCG or to the top stack of the lubricator, the lateral forces acting on the lubricator and wellhead due to the SCG can be reduced or substantially eliminated. One preferred compensation system includes a force sensor assembly for determining a direction and magnitude of lateral forces acting on the lubricator near its connection with the SCG. A force generating assembly is attached to the SCG near the lubricator connection or attached to the top stack of the lubricator near the SCG connection. The sensor assembly readings are converted into command signals to force the generating assembly. The command signals direct the force generating assembly to generate a force substantially equal and substantially opposite to the force sensed by the sensor assembly.

By substantially equal to, the inventor means that the thruster force should be sufficient to reduce lateral forces acting on the lubricator, well tree or well head to within the lateral force tolerances of the lubricator and/or wellhead or well tree. Preferably, the magnitude and direction of the thruster force should be within about 20% of the magnitude and direction of the force sensed by the sensor, particularly, within about 10%, and especially within about 5%. Of course, the ultimate goal is to exactly counter the force acting on the lubricator, well tree and/or wellhead.

Cooperable with the thrusters or force generators at the upper portion of the lubricator or at the lower end of the SCG, force sensors and communication equipment may be attached to the lubricator, the wellhead and/or the SCG can have force. The sensors can determine the magnitude and direction of any lateral forces acting on the lubricator, wellhead and/or the SCG, and the communication equipment can transmit the information to the surface vessel that can then move to minimize or offset the sensed force. The amount and direction of vessel movement will relate to the magnitude and direction of the sensed force. The movement of the vessel can be designed to decrease or minimize or offset the sensed force. The vessel can be equipped with computer software programs that will control the position of the vessel. Engines, thrusters, auxiliary power units, tugs, and the like can be controlled to displace the vessel a certain amount in response to a sensed lateral force, await the next transmission of sensed force data or monitor the continuous sensed force and adjust the position of the vessel to achieve a desired force on the SCG, lubricator and wellhead.

The SCG can have force sensors distributed along its length so that equipment on the vessel can determine the nature of the forces acting on the SCG-lubricator junction as well as forces acting on the SCG over its length. Using the data from these sensors, a computer can determine not only the direction the vessel should move and how much it should move, but also information relating to the magnitude and direction of currents acting on the SCG over its length. Intermediate sensors along the length of the SCG can be arranged to sense tension forces and lateral forces, which can be resolved or summed into tension forces and lateral forces to facilitate force control.

The lubricator used in conjunction with the SCG of the present invention can be constructed to tolerate higher lateral forces. The lubricator can thicken at its base tapering to thinner at the top where it connects to the SCG. The difference in thickness of the lubricator and the length of the lubricator can be adjusted so that the lubricator can undergo lateral deflections without compromising the integrity of the pressurized well. Alternatively, the lubricator can be equipped with a swivel joint or connector between the wellhead and the SCG connector. The swivel joint or connector will enable the lubricator to rotate and swivel in response to lateral forces. Moreover, the lubricator used in conjunction with the SCG of the present invention can include one or all of these force compensation apparatus when needed.

Suitable force generators include, without limitation, any apparatus that generates a force of a given magnitude such as apparatus having propellers or other rotator devices or apparatus having water or air jets or the like. Such apparatus include thrusters.

Suitable SCG materials include, without limitation, continuous metal or composite tubing, open weave metal or composite tubing, Bouden cable, unbonded flexible pipe, spiral wound metal or composite tubing, jointed metal or composite tubing where the joints are capable of withstanding tension and compression in excess of 80 KIPS, or, mixtures or combinations thereof. Preferred metals are iron alloys including, without limitation, stainless steel, chromium steel, chromium, vanadium steel or other similar steels, titanium or titanium alloys or mixture or combination thereof. Preferred composites are fiber reinforced composites such as fiber reinforced resins where the fiber is metal, carbon, boron nitride or other similar fiber that are capable of withstanding tension and compression in excess of 80 KIPS. For continuous metal guides, the preferred SCG is solid steel tubing having an o.d. between about 6" and 2", preferably between about 4" and about 2" and particularly between about 4" and 2½".

Suitable force sensors include, without limitation, accelerometers, strain gauges, piezoelectric transducers, or other similar devices or mixtures or combinations thereof.

Referring now to FIGS. 1–5, one preferred method for inserting coiled tubing into a subsea well is illustrated using a SCG of the present invention. FIG. 1 shows part of a floating vessel 10 with guidewires 70 attached to a wellhead 50, where the SCG wires 70 are in preparation for lowering a subsea lubricator 40 to the wellhead 50. The lubricator 40, as is true with other pressure control equipment, is lowered down and connected to the wellhead 50, to access a pressurized well 51.

Figure 2:
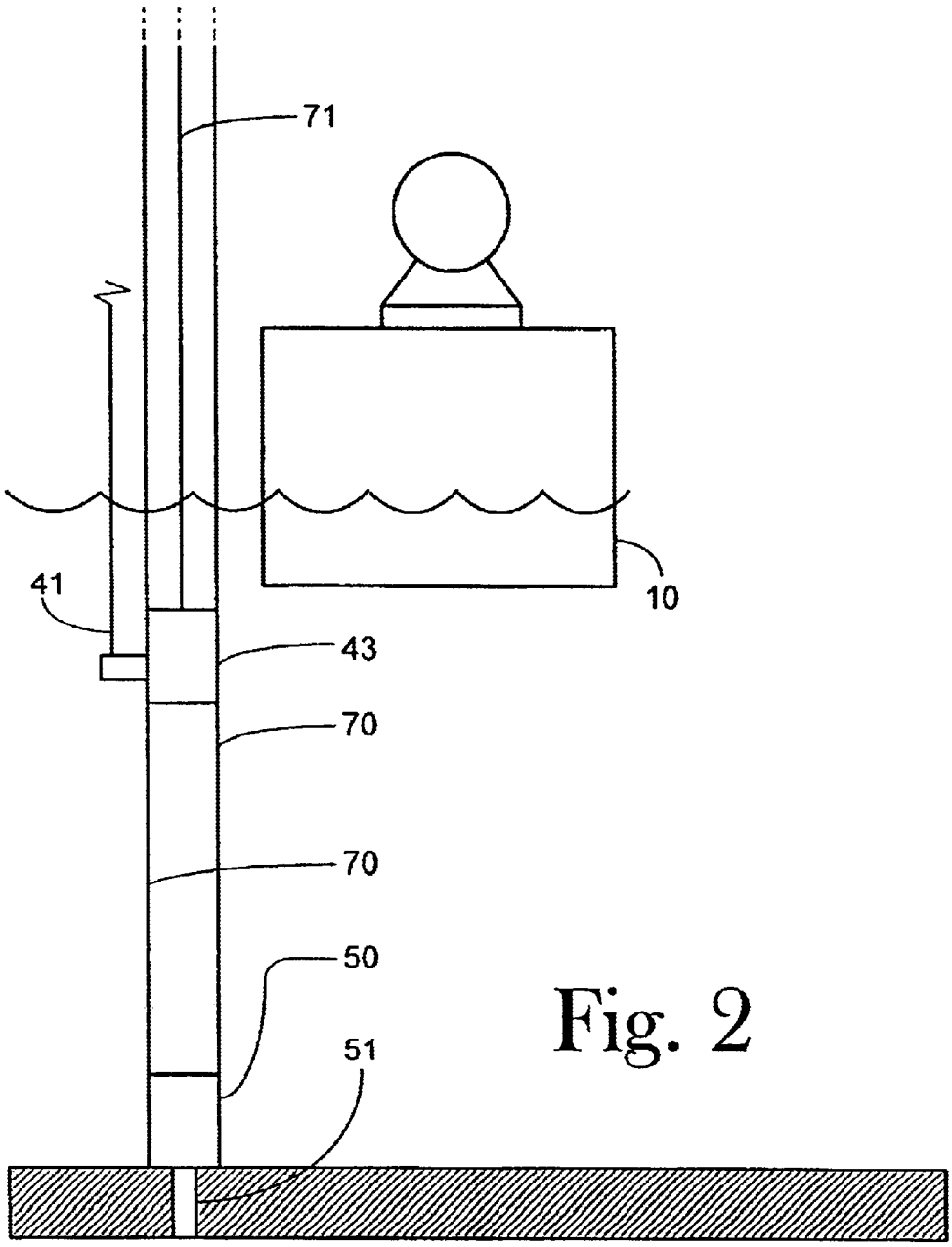
Figure 3:
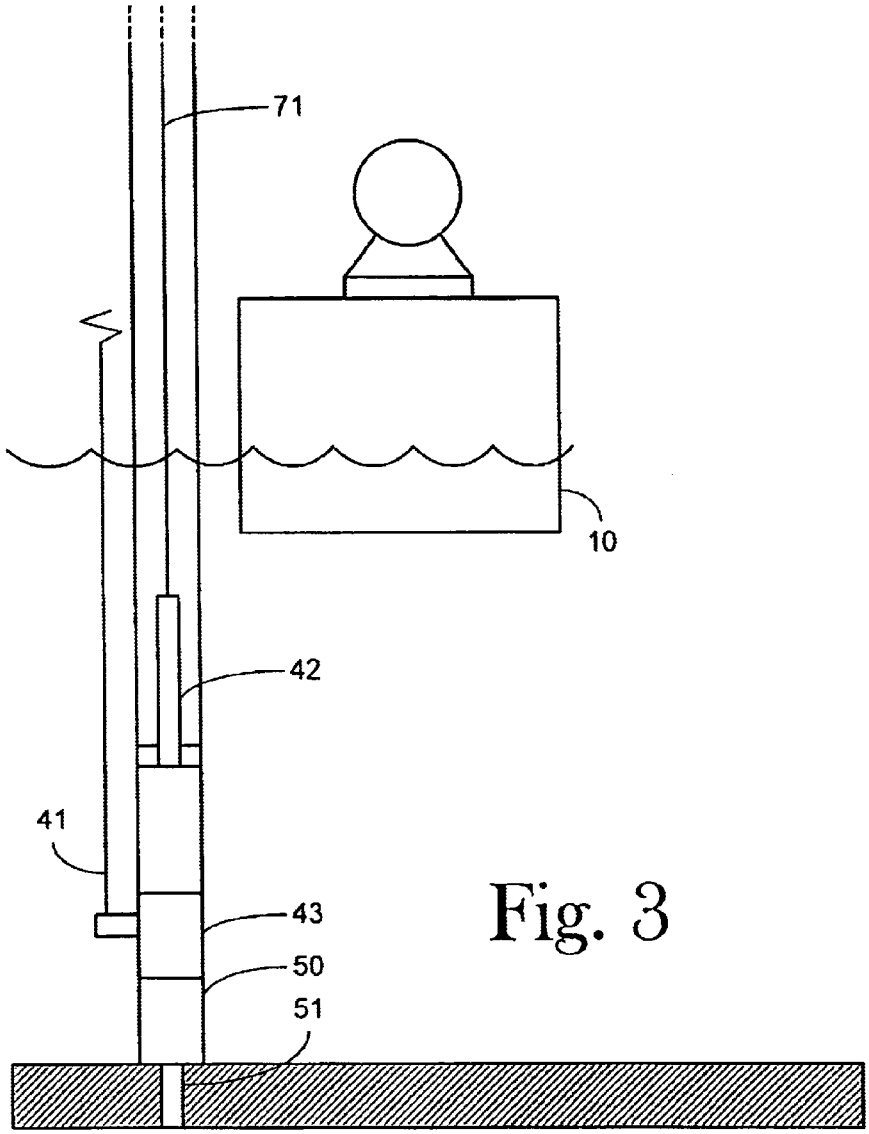
Figure 4:
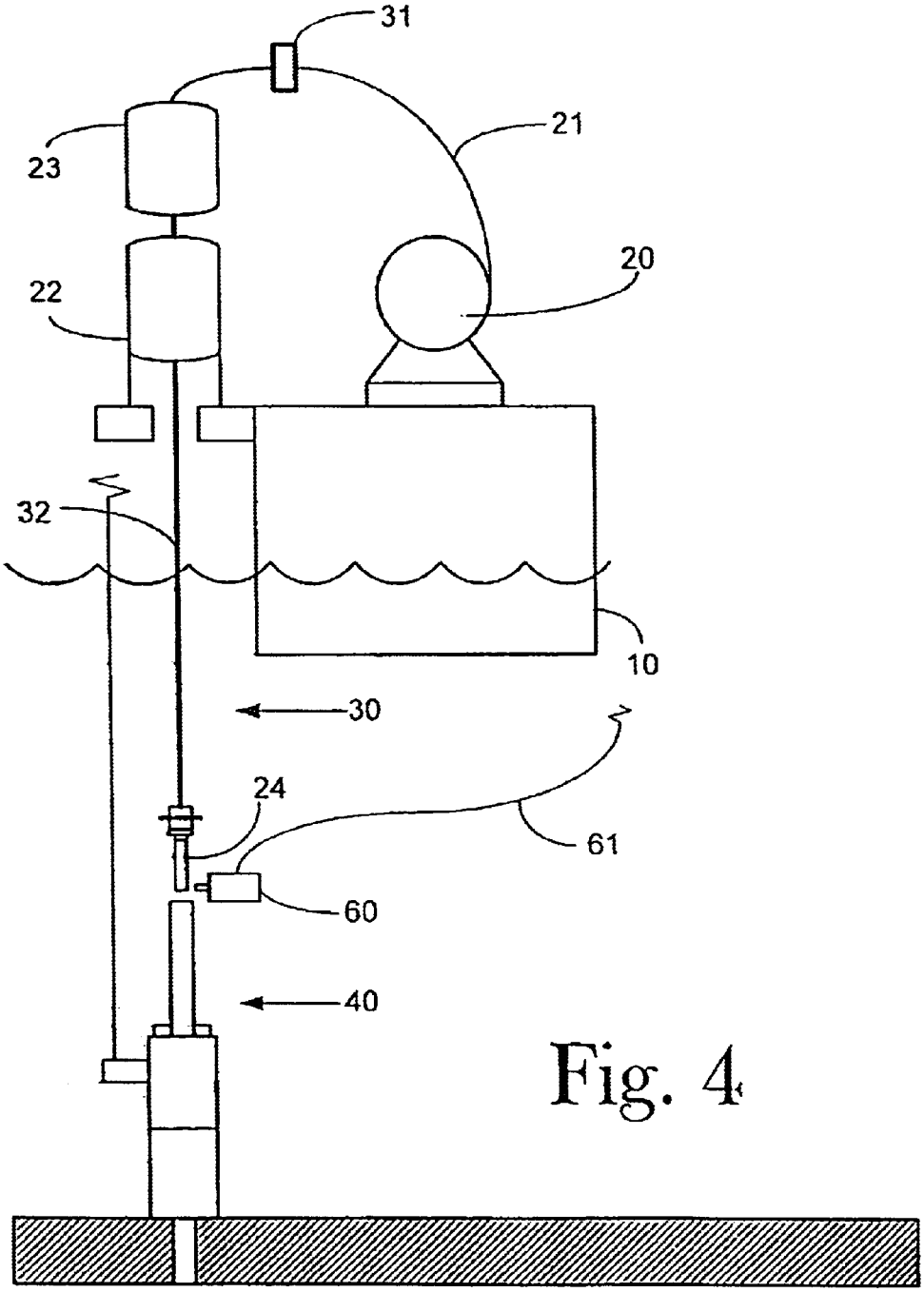

As shown in FIGS. 2–4, the subsea lubricator 40 is deployed in two parts, a bottom stack assembly 43 and then a top lubricator assembly 42. Of course, the subsea lubricator 40 can also be deployed as a single assembly. FIG. 2 shows the bottom stack assembly 43 with its control umbilical 41 attached, being lowered using a lift wire 71. The control umbilical 41 provides control function connections between the floating vessel 10 and the controllable devices in the subsea lubricator 40, wellhead 50 and well 51. The control umbilical 41 can also contain a conduit (not shown) for fluids to flow between the bore (not shown) of the well 51 and the floating vessel 10. Alternatively, the conduit may be a separate conduit independent from the control umbilical 41.

Referring now to FIG. 3, the top lubricator assembly 42 is lowered using the lift wire 71. In this arrangement, an additional control umbilical is not required to be run with the top lubricator assembly 42, because the top lubricator assembly 42 control functions are automatically connected to the control umbilical 41 when the top lubricator assembly 42 mates with the bottom stack assembly 43. At this point, the SCG wires 70 may be disconnected to avoid potential interference with subsequent operations.

Figure 5:
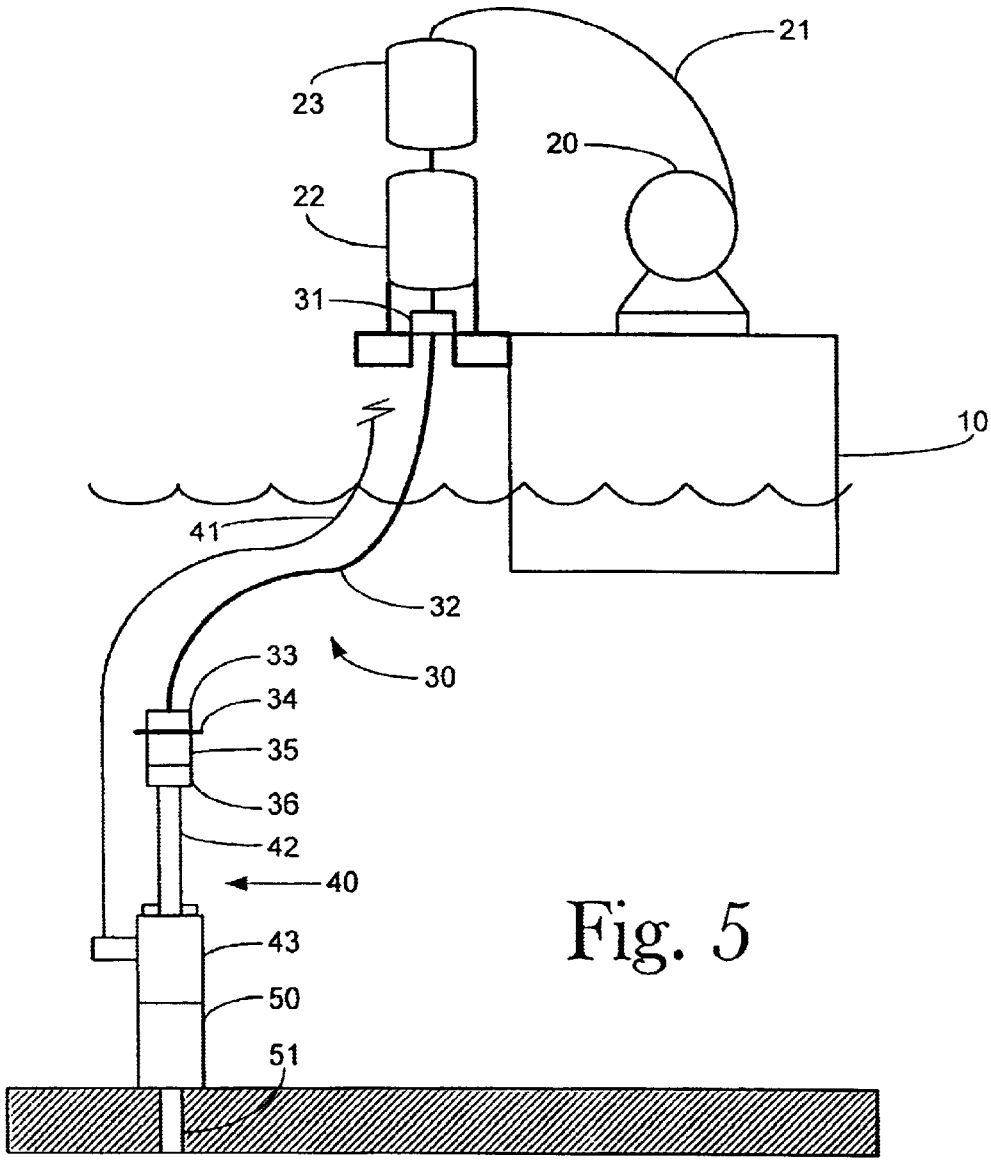

Referring now to FIGS. 4 and 5, the SCG 30 and coiled tubing 21 assembly, complete with coiled tubing toolstring 24, is shown being lowered to the subsea lubricator 40 by means of two injectors 22, 23 in series. A remote operated vehicle 60 guides the toolstring 24 into the subsea lubricator 40, which has a larger inside diameter than the outside diameter of the toolstring 24. The SCG 30 and coiled tubing 21 assembly is lowered until the coiled tubing toolstring 24 is fully inserted into, and the latching means 36 mates with, the subsea lubricator 40.

The SCG 30 continues to be unspooled until it assumes a desired compliant shape as illustrated in FIG. 5 and until it is clear of the injectors 23,24. A hang-off flange 31 at the injector end of the SCG 30 is then attached to the floating vessel 10 close enough to the injectors 22,23 to avoid compression buckling failure as the coiled tubing 21 travels between the injectors 22,23 and hang-off flange 31. The hang-off flange 31 resists gravitational and environmental forces that are applied to the SCG 30.

The two injectors 22, 23 are used in series to enable one to open sufficiently for any large diameter components positioned along the length of the SCG 30 to pass through one of the injectors 22 or 23, while the other injector 22 or 23 continues to grip and move the whole SCG 30 and coiled tubing 21 assembly. An alternative method can be used wherein only a single injector 22 is employed in conjunction with an abandonment and recovery wire (not shown) operated by a winch (not shown) detachably connected to the SCG 30.

On completion of the lowering operation, the SCG 30 is clear of the injectors 22, 23, the hang-off flange 31 is attached to the floating vessel 10, and one of the injectors 22,23 can then grip the coiled tubing 21 in preparation for moving it into the well 51. Once the task in the well 51 is finished, the injector 22 can pull the coiled tubing 21 out of the well 51 until the toolstring 24 is inside the subsea lubricator 40 thereby enabling the well 51 to be sealed below it by means of valves (not shown) in the wellhead 50 and subsea lubricator 40. The SCG 30 can then be unlatched and the complete assembly including the SCG 30, the coiled tubing 21 and the coiled tubing toolstring 24 can be recovered or spooled back on to the floating vessel 10 by the reverse of the above-described process.

Some tasks do not require coiled tubing toolstrings 24 that are greater in diameter than the coiled tubing 21 itself. In such instances, the coiled tubing 21 is not inserted into the SCG 30 prior to its deployment. Instead, the coiled tubing 21 can be introduced into and retracted from the SCG 30 and the well 51, while the SCG 30 is latched to the subsea lubricator 40 and fixed to the floating vessel 10.

It should be recognized to those of skill in the art, that pressure control devices used with subsea lubricators designed for wireline operations may not be suitable for both wireline and coil tubing operations. To enable the use of both wireline and coiled tubing components and procedures, additional pressure control devices such as BOP's suitable for both wireline and coiled tubing should be provided in conjunction with the subsea lubricator.

The SCG 30 is of sufficient length to reach between the floating vessel 10 and the subsea lubricator 40 and assumes a compliant shape whereas the coiled tubing 21 is of sufficient length to penetrate to the depths of the well 51 and is generally much longer than the SCG 30.

The compliant quality of the SCG 30 as it extends from the subsea lubricator 40 to the floating vessel 10 enables dynamic bending and thus provides a means of compensating for the heave motions of the floating vessel 10 and thereby avoids the need for special heave compensation devices for both the SCG 30 and the injectors 22 and 23.

At the injector end of the SCG 30, a hang-off flange 31 is provided that attaches to the floating vessel 10 and resists all forces applied to the SCG 30.

The SCG 30 is of sufficient length to assume a compliant shape between the floating vessel 10 and the subsea wellhead 50 substantially regardless of the distance or depth. The inside diameter of the SCG 30 is small enough to prevent the coiled tubing 21 from buckling due to compression between the injector 22 at one end and the annular well seal 35 at the other. This close fit affords an advantage over prior art methods, in which risers are used as conduits for the coiled tubing toolstring, by allowing for a significant reduction in outside diameter and therefore a significant reduction in the effect of environmental forces. Because no well fluids or well pressures are present within the SCG 30, the design of the tubular main body 32 can be optimized for tension, compression and bending moments caused by the motion of the vessel, the environmental forces and the forces applied to the coiled tubing 21 inside.

Figure 6A:
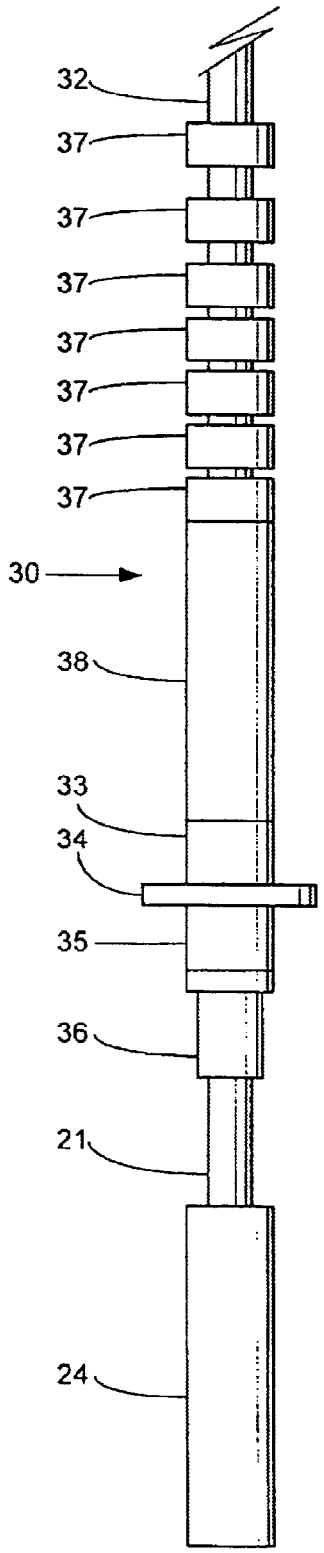
FIG. 6A illustrates the subsea lubricator end of a general arrangement of the SCG that has coiled tubing through it and a coiled tubing toolstring on the end and a bend resistor and buoyant blocks.
Figure 6B:
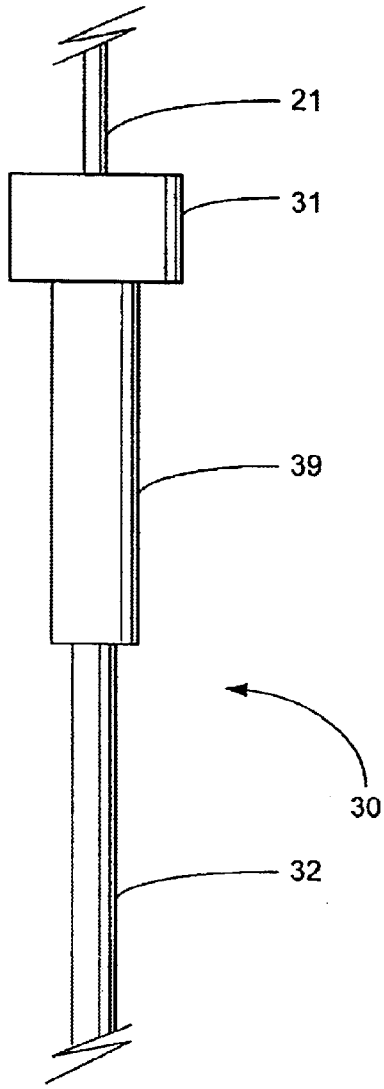
FIG. 6B illustrates the injector end of a general arrangement of the SCG that has coiled tubing through it and a bend resistor.

Referring now to FIGS. 6A and 6B, the SCG 30 can include specialized attachments that can aid the SCG in assuming a desired compliant shape. These attachments include, without limitation, buoyant blocks, weights and bend resistors. One preferred use of these specialized attachments is shown in FIG. 6A where the SCG 30 nearest the wellhead 50 includes a bend restrictor 38 and a plurality of buoyant blocks 37. Another preferred use of these attachments is shown in FIG. 6B where the SCG 30 nearest the flange 31 includes a bend restrictor 39. Additionally, clamping weights (not shown) can be positioned along the injector end of the SCG 30. Moreover, these attachments can also be positioned along the length of the SCG 30 to urge the SCG into a given compliant shape. Using a metal tube for the SCG 30 will likely require the addition of buoyancy to the SCG 30 so that it will assume a desired compliant shape, while using a composite material, such as a mixture of resin and carbon fibre, for the SCG 30 will likely require the addition of weights to the SCG so that it will assume a desired compliant shape. The bend restrictors 38,39 are provided at either end of the main body 32 of the SCG 30 to reduce bending of the SCG 30 near its ends.

As the coiled tubing 21 moves inside the curved shape of the SCG 30, the tubing 21 is subjected to frictional forces that increase as curvature increases. Since it is desirable to have the SCG 30 in a compliant shape, while the coiled tubing 21 is moving, undesirable frictional forces may be present.

Figure 7:
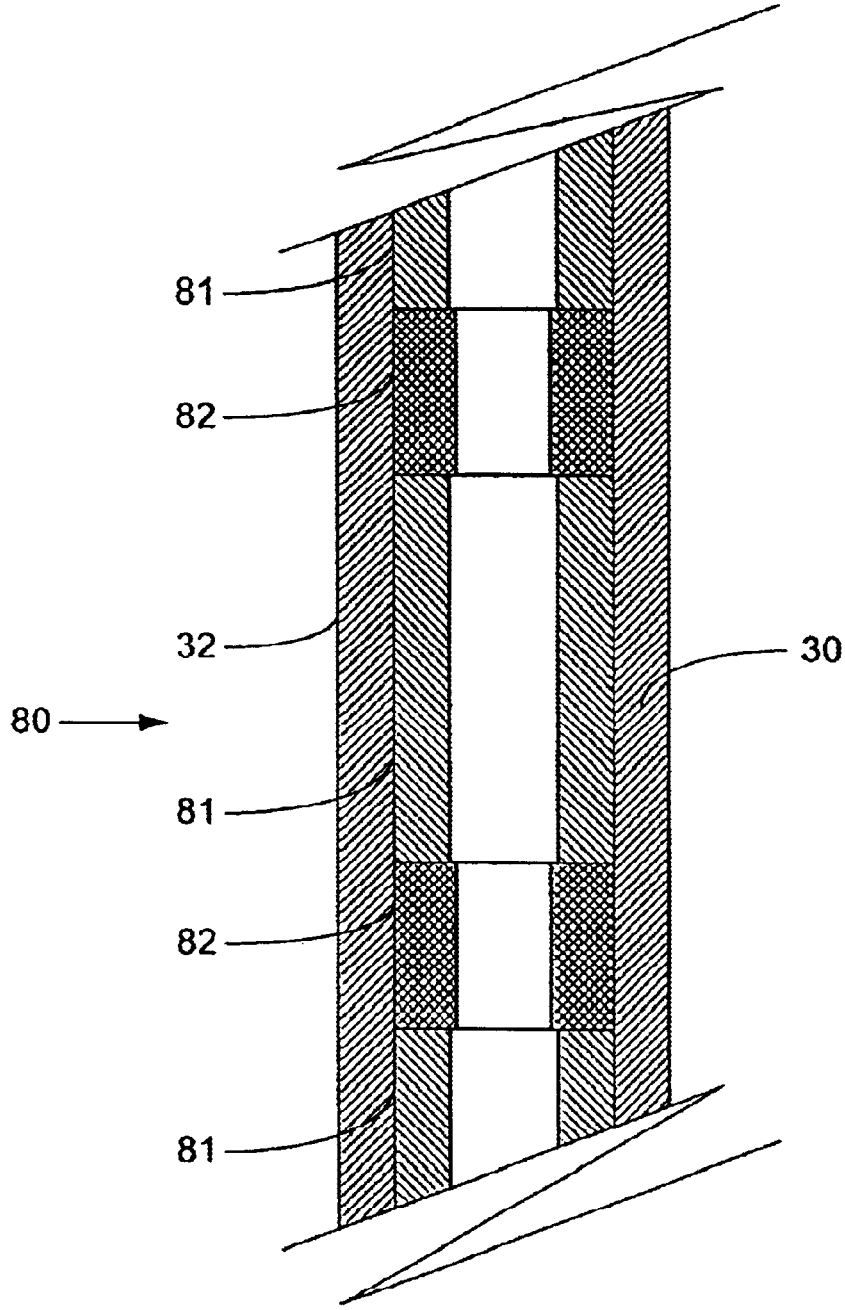
FIG. 7 illustrates a cross sectional view of part of the main body of the SCG showing an anti-friction insert.

Referring now to FIG. 7, a further embodiment of an SCG 30 of the present invention is shown that is designed to reduce such frictional forces. The embodiment includes an anti-friction assembly 80 located inside the SCG 30. This anti-friction assembly 80 includes a plurality of linear bearings 82, which can be of a low friction material bearing type or ball bearing type. These linear bearings 82 are positioned at intervals along the length of the SCG 30 and can be held in place by means of a plurality of spacer tubes 81. The spacer tube 81 at each end of the SCG 30 is fixed in place thus fixing the whole anti-friction assembly 80 in place. Alternatively, the anti-friction assembly 80 can be a low friction liner extending the entire length or positioned at desired locations along the length of the SCG 30.

An alternative friction reduction embodiment of the present invention entails filling an annular space between the coiled tubing 21 and the SCG 30 with a lubricating medium such as an oil, grease or similar material or mixtures or combination thereof. In this alternative embodiment, an additional annular seal (not shown) is provided adjacent to the hang-off flange 31 so that the lubricating medium can be contained within the SCG 30 and/or pressurized. A pressurized lubricating medium provides not only lubrication, but also acts to reduce extrusion forces at the annular well seal 35 and hence reduces compression forces seen by the coiled tubing 21 inside the SCG 30.

When the coiled tubing 21 is extracted from a well 51, it usually experiences tension forces. The deeper the penetration of the coiled tubing 21 into the well 51, the larger these tension forces become. In this invention, the SCG 30 will experience compression forces which are substantially equal to the tension forces experienced by the coiled tubing 21 at any point along the length of the SCG 30. The SCG 30 can resist these compression forces, especially if the SCG 30 is fashioned from non-bonded flexible pipe, homogeneous steel or a composite material such as a fibre reinforced epoxy where the fiber is carbon fiber, boron nitride fiber, kevlar, glass, or similar fibers or mixtures or combinations thereof.

Steel may be used for the main body 32 of the SCG 30; however, steel is likely to experience fatigue due to the motion of the floating vessel 10 and risk breaking or, at least, some shortening of its useful life. Because of the risk of fatigue, a riser (not shown) made as a continuous steel tube, like the coiled tubing, which also has pressurized well fluids inside, would be considered a relatively high risk application. However, the consequences of an SCG 30 breaking are much less since the pressurized well fluids are held back by the annular well seal 35 at the top of the subsea lubricator 40.

The main body 32 of the SCG 30 can be constructed from a composite material that can be Fiberspar Spoolable Pipe such as is commercially available from Fiberspar Spoolable Products Inc., West Wareham, Mass. 02576 USA. An SCG 30 made from composite materials is preferably matched with composite coiled tubing which can also be Fiberspar Spoolable Pipe.

Dynamic positioning, rather than anchors, is the preferred method for keeping a floating vessel 10 on station above a wellhead 50 in relatively deep water. Using dynamic positioning runs the risk that the floating vessel 10 can accidentally and quickly stray away from its desired position above the wellhead 50. Anything connected between the floating vessel 10 and the well 51 can be damaged, or cause damage, unless disconnected quickly in response to such an unintended excursion. The time available for emergency disconnection can be as little as 30 seconds. In the case of a pressurised oil or gas well, the consequences of damage can be both dangerous to personnel and polluting to the environment.

Figure 8:
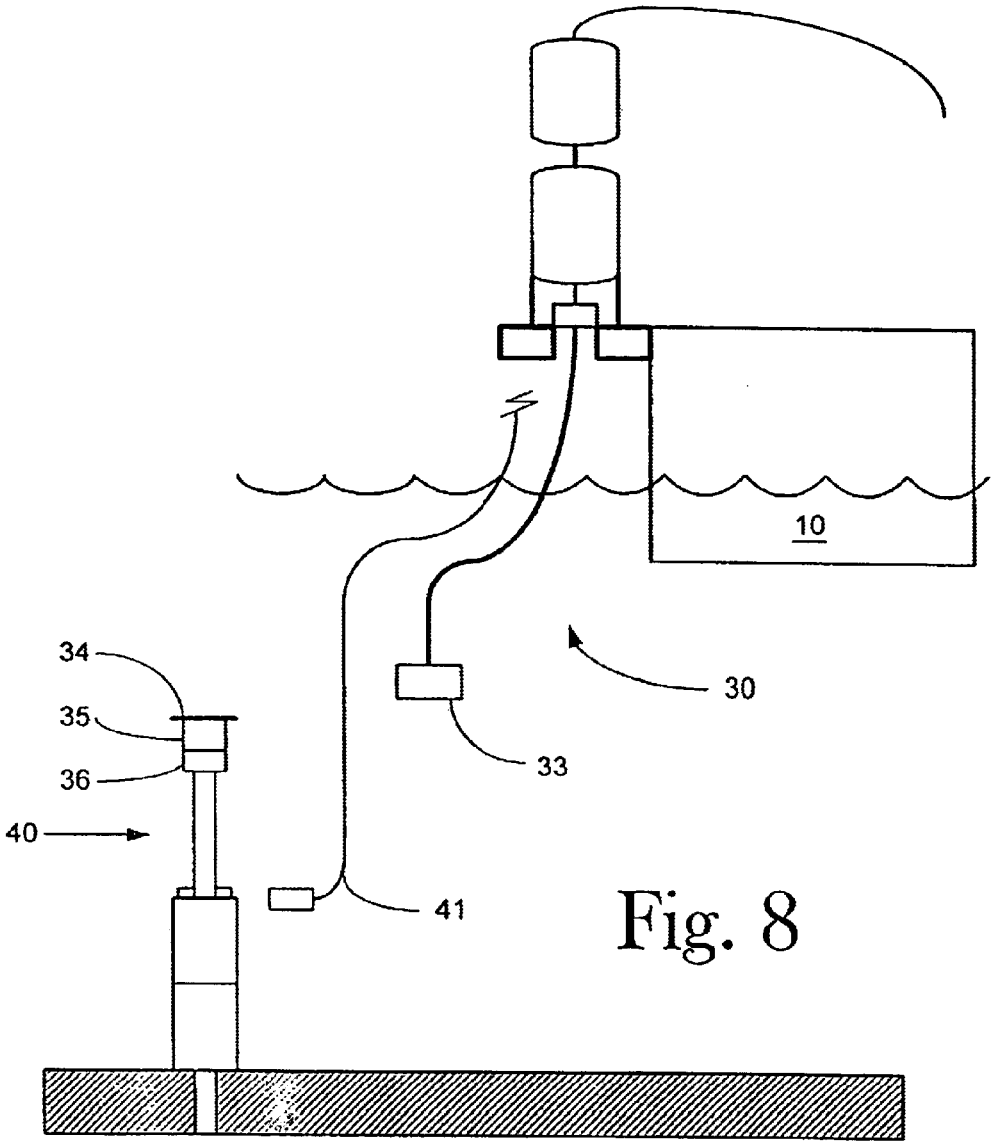
FIG. 8 illustrates the situation after an emergency disconnection of the SCG and coiled tubing system.

Referring now to FIG. 8, a situation is illustrated where the floating vessel 10 has accidentally migrated from its position over the wellhead 50, and the emergency disconnection systems have been activated. Emergency disconnection of the SCG 30 leaves the annular well seal 35 attached to the subsea lubricator 40, and emergency disconnection of the control umbilical 41 causes pressure control devices in the subsea lubricator 40 to activate. If the SCG 30 has coiled tubing therein, then the coiled tubing 21 can be cut above the annular well seal 35 by a cutter 34. An advantage of the SCG 30 is that, since neither it nor the coiled tubing 21 have well fluids inside, the risks associated with emergency disconnection are considerably reduced from prior art systems which use risers that do have well fluids inside. Also the emergency disconnection means can be of a much simpler and lower cost design than disconnection devices which must work with pressurised well fluids present.

At the subsea lubricator end of the SCG 30, a latch 36 is provided for connecting to the subsea lubricator 40, above which is provided an annular well seal 35 for coiled tubing 21 often referred to as a stuffing box or stripper. Above the latch 36 and annular well seal 35, preferably there is provided a hydraulically actuated coiled tubing cutter 34 and an emergency disconnect 33. Should rapid emergency disconnection be required, the coiled tubing 21 is cut and disconnected above the annular well seal 35.

Figure 9:
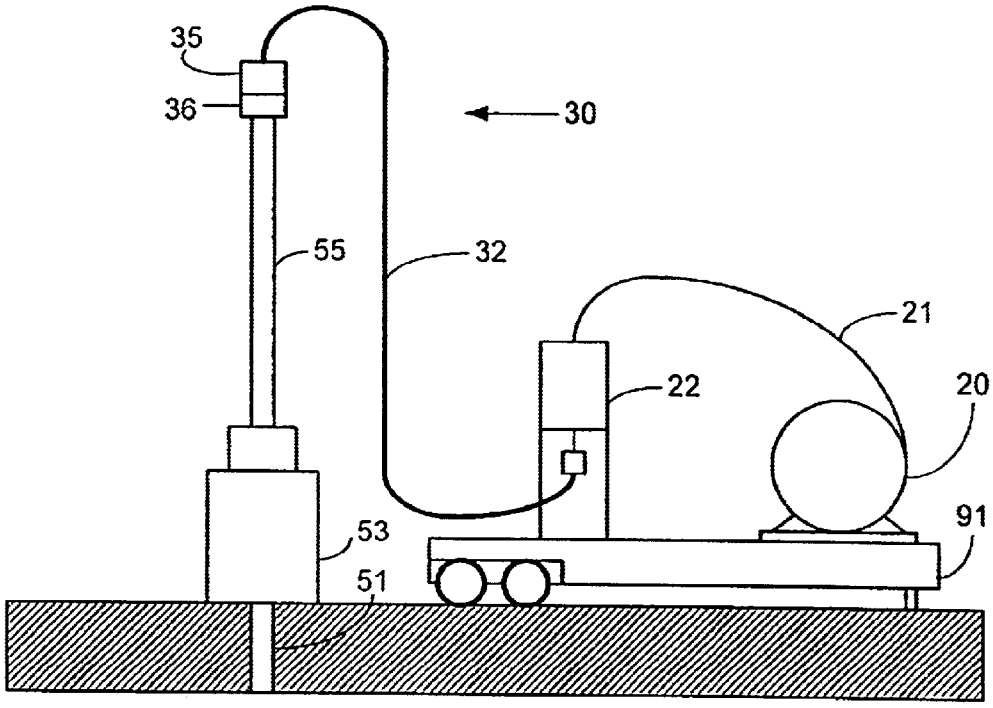
FIG. 9 illustrates a general arrangement of a coiled tubing system on a transportation trailer connected by an SCG to a lubricator and wellhead on land ready for downhole coiled tubing operations.
Figure 10:
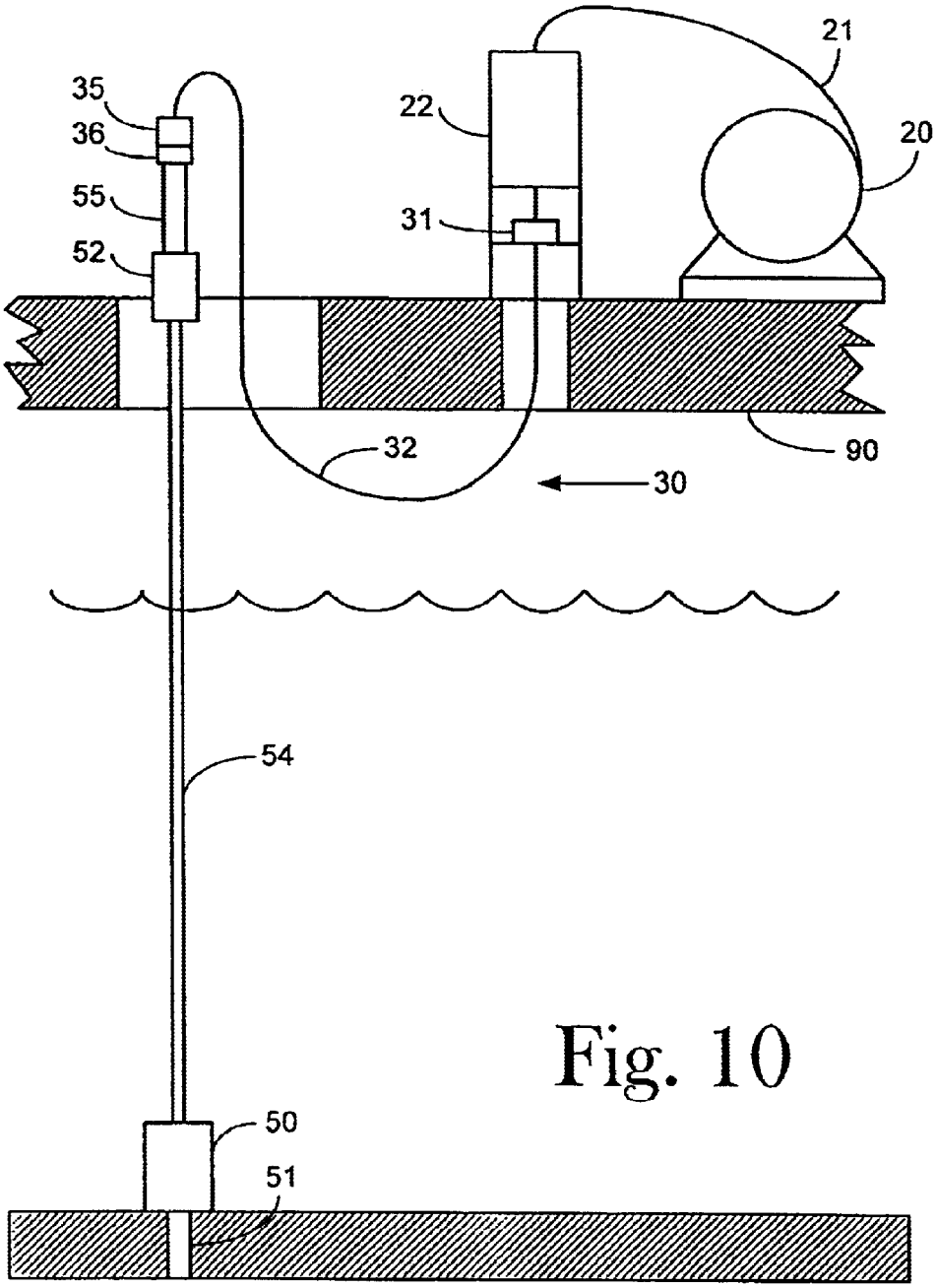
FIG. 10 illustrates a general arrangement of a coiled tubing system on the deck of an offshore platform or drilling rig connected by an SCG to a lubricator above a surface tree ready for downhole operations.
Figure 11:
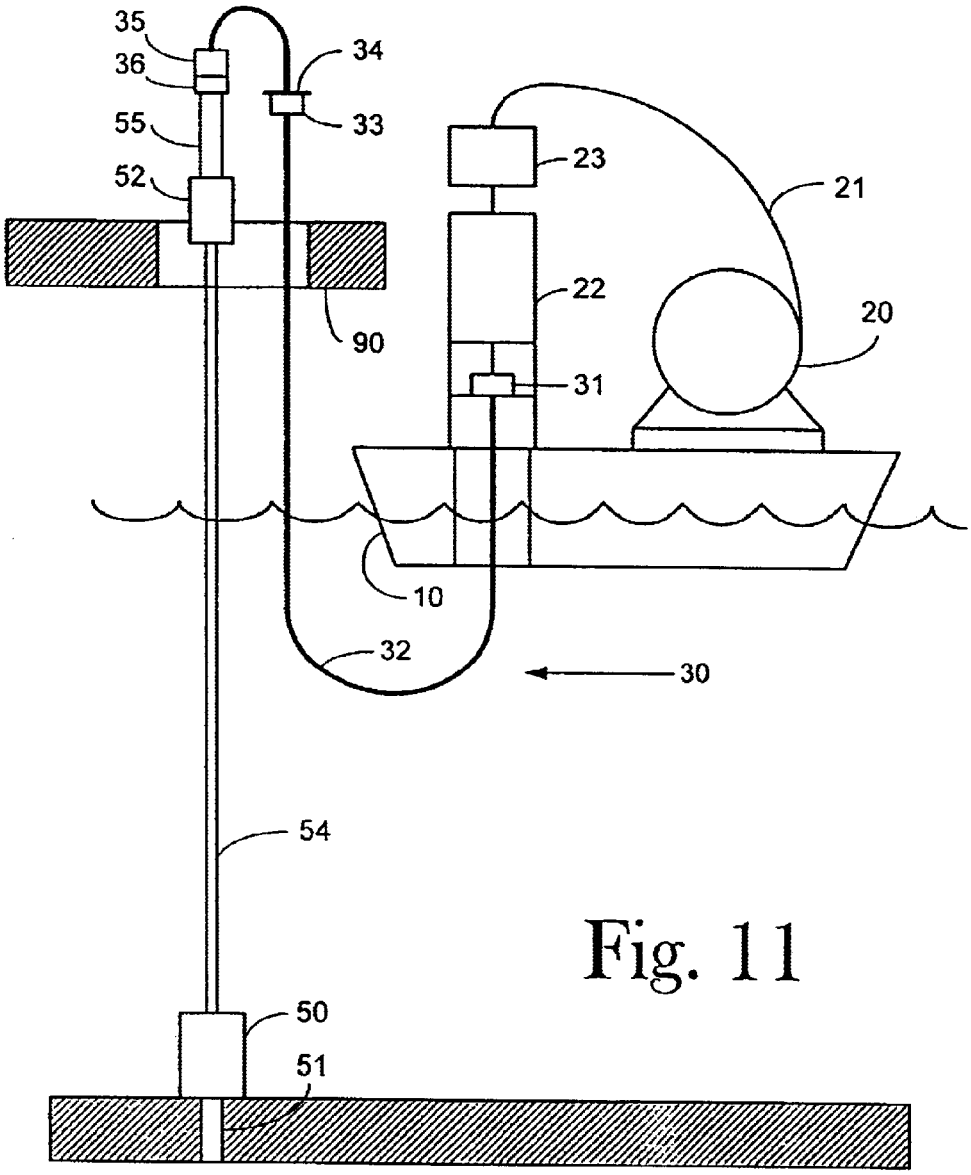
FIG. 11 illustrates a general arrangement of a coiled tubing system on a floating vessel connected by an SCG to a lubricator above a surface tree on a separate offshore platform or drilling rig ready for downhole operations.

The SCG 30 can be used on a land well or on an offshore well with its wellhead above or below the surface of the sea as shown in FIGS. 9–11. Referring now to FIG. 5, for a well 51 with its tree 53 on land, an injector 22 can be positioned near the well 51 on a transportation trailer 91 while an SCG 30 connects between it and the top of a lubricator 55 above the tree 53. As shown in FIG. 6 in the case of an offshore well with a surface tree or wellhead 52, an injector 22 can be positioned on the deck of a wellhead platform or drilling rig 90 while an SCG 30 connects between it and the top of a lubricator 55. Alternatively, as illustrated in FIG. 7, an injector 22 can be on a vessel 10 that is moored or positioned alongside a wellhead platform or drilling rig 90 while an SCG 30 connects between the injector 22 and a lubricator 55 on the surface tree 52. As shown in FIG. 5 in the case of a well 51 with a subsea wellhead 50, an injector 22 can remain on the deck of a vessel 10 while an SCG 30 connects it to a subsea lubricator 40 on the subsea wellhead 50.

The method of using an SCG 30 is similar in all these cases. Since the subsea case is the most complex it has been described in more detail. Use of the SCG 30 on the other non-subsea cases will be readily apparent to those skilled in the art from the attached written specification, drawings and claims.

Access may be required at different stages in the life of a well 51 which means that either only a wellhead or both a wellhead and a subsea tree may be present above a well 51 that is underwater. All references to a wellhead 50 are also intended to encompass subsea trees.

Figure 12:
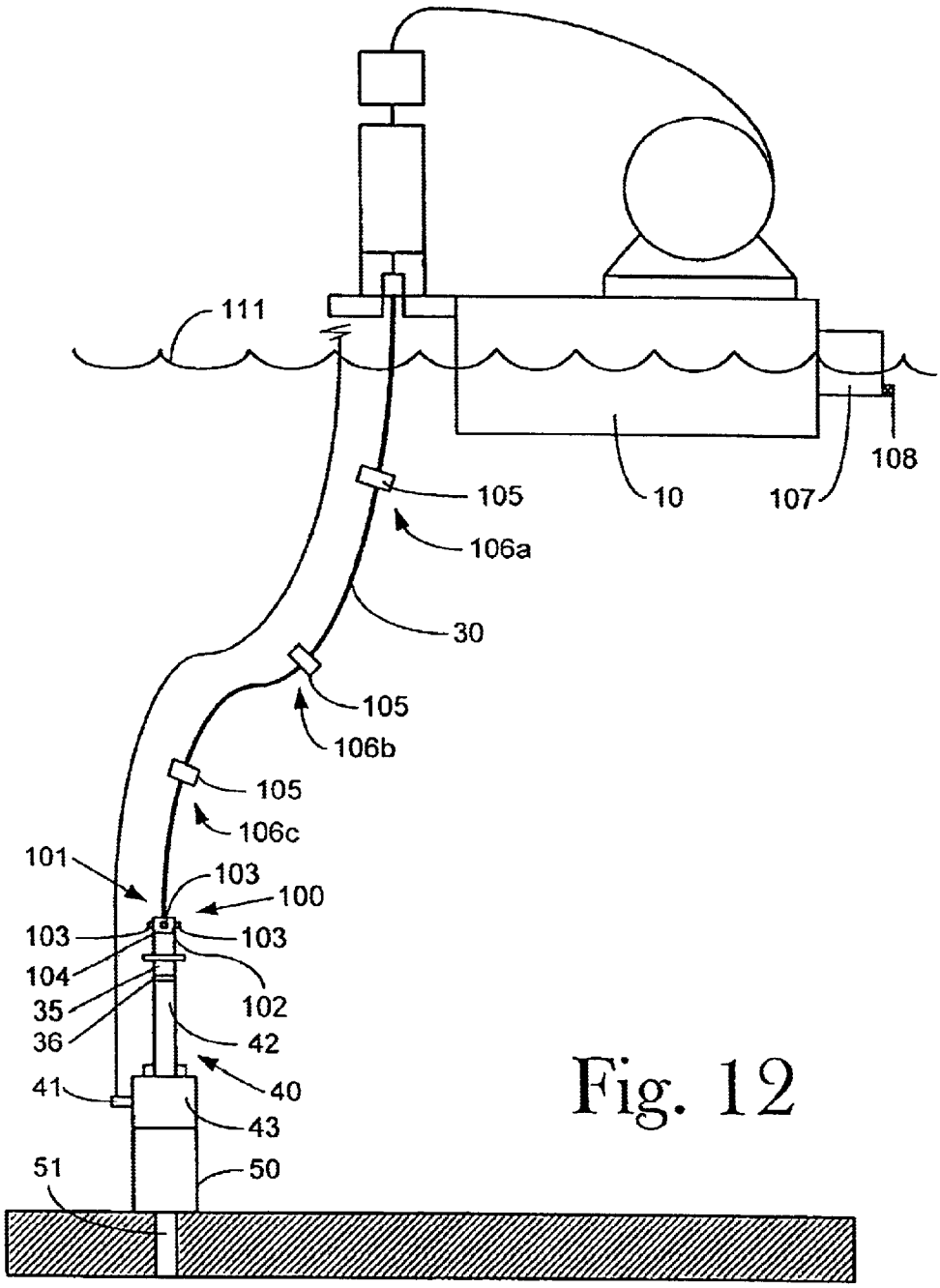
FIG. 12 illustrates a sensor associated with a distal end of an SCG of the present invention and associated sensor analysis and communication hardware and software for detecting, qualifying and communicating lateral force information to a force compensation apparatus associated with the proximal end of the SCG or to a vessel response system for repositioning the vessel in response to the lateral force information.

Referring now to FIG. 12, the SCG system of FIG. 5 is shown to include in addition the elements described in FIGS. 1–5, a distal end force compensation system 100 (sometimes referred to as an "FCS") associated with a distal end 101 of an SCG 30. The FCS 100 includes a force sensing unit 102. The force sensing unit 102 includes force sensors (not shown) and associated electronics (not shown) for determining a magnitude and direction of lateral forces acting on the lubricator 40 and/or the wellhead 50 due to the connected SCG 30 and conduits thereinside. The FCS 100 also includes four thrusters 103 with each thruster 103 positioned approximately 90° apart on four circumferential faces 104 of the force sensing unit 102. The FCS 100 also includes electronics (not shown) to control the four thrusters 103 so that the thrusters 103 can produce a lateral force substantially equal and opposite to the sensed lateral force.

The FCS operates by sensing the lateral forces acting on the lubricator due to the attachment of the SCG and conduits thereinside. If the forces are within the tolerances of the lubricator and wellhead, then no action need be taken. However, when the lateral forces approach, achieve or surpass the lateral force tolerance of the lubricator and/or wellhead, then the FCS determines the magnitude and direction of the sensed lateral force and causes the appropriate thruster(s) or other force generating means to produce a force substantially equal to and opposite the sensed force. Although, the embodiment shown in FIG. 12 utilizes four thrusters, a single radially positionable thruster can be used so long as the FCS can generate a reaction force substantially equal and opposite the sensed force.

In addition to the force sensing unit 102 associated with the FCS 100, the SCG 30 of FIG. 12 also includes secondary force sensing units 105 located at positions 106*a–c* along the length of the SCG 30. These units 105 contain sensors, associated electronics to determine the magnitude and direction of forces acting on the SCG 30 at positions 106*a-c* as well as communication hardware and software (not shown) for transmitting the information to a vessel response unit 107 which includes communication electronics, communication hardware and software (not shown) and a vessel repositioning apparatus 108 such as a propeller.

The vessel response unit 107 can be used instead of or in conjunction with the thrusters 103 to reduce or minimize lateral forces acting at the distal end 101 of the SCG 30 near the annular seal 35 or the latching means 36 connected to the top part 42 of the lubricator 40. The vessel response unit 107 acts to reduce or minimize such lateral forces by repositioning the vessel 10 in response to the force data received by the force sensing units 102 and 105. The vessel response unit 107 causes the vessel 10 to move using apparatus 108 in a direction that produces a lateral force at the connection between the SCG 30 and the lubricator 40 substantially equal and opposite to the lateral force sensed at the distal end 101 of the SCG 30. It should be recognized by those skilled in the art that a FCS can be associated with the lubricator 40 instead of or in conjunction with the FCS 100 associated with the distal end 101 of the SCG 30.

Figure 13:
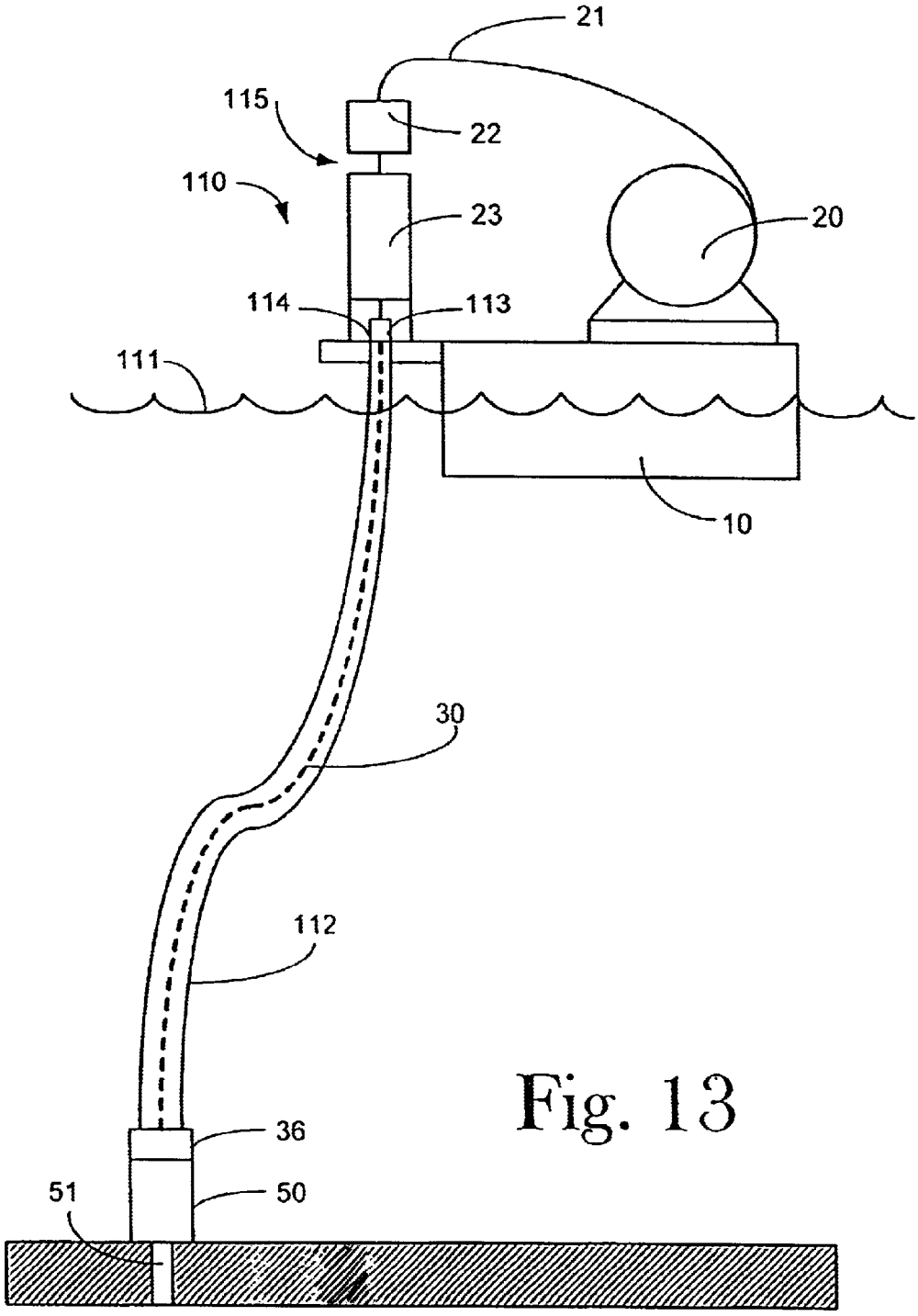
FIG. 13 illustrates a general arrangement of an unbonded riser having an SCG with coiled tubing therein inserted into the riser and extending to the wellhead from a vessel or platform associated with a proximal end of the riser.

Referring now to FIG. 13, an SCG system 110 is shown associated with a seabed wellhead 50 extended to a surface 111 by a flexible riser 112 such as an unbonded flexible pipe riser associated with a vessel 10. It should be recognized by ordinary artisans that the SCG system 110 can also be used with a platform 90 or a trailer 91. The SCG system 110 includes having an SCG 30 extending from an annular seal 113 associated with a top or proximal end 114 of the riser 112 to the wellhead 50 where the SCG 30 can optionally include a latching means 36 for connecting to the wellhead 50.

The SCG system 110 also include coiled tubing 21 running inside the SCG 30 which in turn runs inside the riser 112. The SCG system 110 also includes a coiled tubing injector system 115 which includes at least one injector 23 and preferably two injectors 22 and 23 and a coiled tubing reel 20. The SCG 30 with the coiled tubing 21 and toolstring 24 are inserted into the riser 112 through the annular seal 113 until the toolstring 24 encounters the wellhead 50. The injector system 115 then injects the toolstring 24 and connected tubing 21 to perform a desired coiled tubing well operation. Once the operation is completed, the injector system 115 removes the coiled tubing 21 and associated toolstring 24 from the well 51.

As the tubing 21 is removed, the SCG 30 experiences compressive forces equal and opposite to the tension forces experience by the tubing 21 due to the compliant shape of the flexible riser 112 and the inserted SCG 30. Because the SCG 30 is reactive with the tubing 21 during extraction, the riser 112 is spared having to endure compression forces during coiled tubing operations. Although the SCG system of the present invention is ideally suited for risers made of unbonded flexible piping which assumes a compliant shape in the water, the SCG system of the present invention can also be used with traditional rigid risers.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from this description those of skill in the art may appreciate changes and modification that may be made which do not depart from the scope and spirit of the invention as described above and claimed hereafter.

I claim:

1. A system for inserting coiled tubing into an installation comprising:

a coiled tubing;

a spoolable compliant guide including a distal end having a connector adapted to detachably connect proximate the installation and a proximal end having a connector; and an injector apparatus adapted: to receive the guide, to detachably hold the guide at its proximal end connector after the distal guide end is detachably connected proximate the installation, and to inject the coiled tubing into the installation or withdraw the coiled tubing from the installation via the guide, where the guide forms a compliant conduit between the injector apparatus and the installation, which is isolated from the installation and through which the coiled tubing accesses the installation.

2. The system of claim 1, wherein the installation comprises an oil and/or gas well.

3. The system of claim 1, wherein the injector apparatus comprises at least one injector adapted to grip and move the guide so that the distal guide end connects proximate the installation and to grip and move the coiled tubing through the guide and into and out of the installation.

4. The system of claim 1, further comprising:

a tool detachably connected to a distal end of the coiled tubing.

5. The system of claim 1, further comprising:

a guide spool upon which the guide is spooled; and a coiled tubing spool upon which the coiled tubing is spooled.

6. The system of claim 1, further comprising:

a spool upon which a length of the guide is spooled sufficient for the guide to assume a compliant shape between the injector apparatus and the installation and a length of coiled tubing extending from the distal end of the guide out past the proximal end of the guide a sufficient amount to allow the coiled tubing to be inserted into the installation through the guide to a desired position within the installation.

7. The system of claim 1, wherein the installation comprises a subsea installation.

8. The system of claim 7, wherein the subsea installation comprises a subsea oil and/or gas well.

9. The system of claim 8, further comprising:

a vessel upon which the injector apparatus is mounted; and a lubricator including:

a first end adapted to detachably connect to the distal end guide connector; and a second end adapted to detachably connect to a wellhead or seabed tree; and a remote operated vehicle adapted to guide the distal end of the guide from the injection apparatus to a position proximate the lubricator to permit connection of the guide to the first end of the lubricator.

10. The system of claim 9, wherein the lubricator further includes:

a coiled tubing tool having a detachable connector a dapted to detachably engage the coiled tubing distal end to form a tool string prior to insertion into the well;

a seal adapted to isolate the guide from well fluids and fluid pressures; and a blowout preventer adapted to prevent a blowout.

11. A system for inserting coiled tubing into an installation comprising:

a platform;

a coiled tubing including a first end;

a spoolable compliant guide including a distal end having a distal connector adapted to detachably connect proximate the installation and a proximal end having a proximal connector; and an injector apparatus mounted on the platform and adapted: to receive the guide, to detachably hold the guide at its proximal connector after the distal guide end is detachably connected proximate the installation, and to inject the coiled tubing into the installation or withdraw the coiled tubing from the installation via the guide, where the guide forms a compliant conduit between the installation and the injector apparatus, which is isolated from the installation and through which the coiled tubing accesses the installation.

12. The system of claim 11, wherein the platform comprises a vessel, a vehicle, or a drilling rig.

13. The system of claim 11, wherein the installation comprises an oil and/or gas well.

14. The system of claim 11, wherein the injector apparatus comprises at least one injector adapted to grip and move the guide so that the distal guide end connects proximate the installation and to grip and move the coiled tubing through the guide and into and out of the installation.

15. The system of claim 11, further comprising:

a tool detachably connected to the coiled tubing first end.

16. The system of claim 11, further comprising:

a guide spool mounted on the platform upon which the guide is spooled; and a coiled tubing spool mounted on the platform upon which the coiled tubing is spooled.

17. The system of claim 11, further comprising:

a spool mounted on the platform upon which a length of the guide is spooled sufficient for the guide to assume a compliant shape between the injector apparatus and the installation and a length of coiled tubing extending from the distal end of the guide out past a proximal end of the guide a sufficient amount to allow the coiled tubing to be inserted into the installation through the guide to a desired position within the installation.

18. The system of claim 11, wherein the installation comprises a subsea installation and the platform comprises a vessel.

19. The system of claim 18, wherein the subsea installation comprises a subsea oil and/or gas well.

20. The system of claim 19, further comprising:

a lubricator including:

a first end adapted to detachably connect to the distal end guide connector; and a second end adapted to detachably connect proximate a wellhead or seabed tree; and a remote operated vehicle adapted to guide the distal end of the guide from the injection apparatus to a position proximate the lubricator to permit connection of the distal end of the guide to the first end of the lubricator.

21. The system of claim 20, wherein the lubricator further includes:

a coiled tubing tool having a detachable connector adapted to detachably engage the coiled tubing distal end to form a tool string prior to insertion into the well;

a seal adapted to isolate the guide from well fluids and fluid pressures; and a blowout preventer adapted to prevent a blowout.

22. The system of claim 19, further comprising an umbilical adapted to allow control from the vessel of controllable functions associated with the installation, the lubricator and the guide.

23. The system of claim 19, further comprising a winch adapted to lower the lubricator to the installation.

24. A system for inserting coiled tubing into a submerged installation comprising:

a vessel;

a coiled tubing including a first end;

a spoolable compliant guide including a distal end having a distal connector adapted to detachably connect proximate the installation and a proximal end having a proximal connector;

an injector apparatus mounted on the vessel and adapted: to receive the guide, to detachably hold the guide at its proximal connector after the distal guide end is detachably connected proximate the installation, and to inject the coiled tubing into the installation or withdraw the coiled tubing from the installation via the guide;

a lubricator including a proximal end adapted to detachably connect to the distal guide connector and a distal end adapted to detachably connect proximate an installation connector; and a remote operated vehicle adapted to guide the distal end of the guide from the injector apparatus to a position proximate the lubricator to permit connection of the guide to the lubricator, where the guide forms a compliant conduit between the injector apparatus and the installation, which is isolated from the installation and through which the coiled tubing accesses the installation.

25. A The system of claim 24, further comprising:

a tool detachably connected to a distal end of the tubing.

26. The system of claim 24, wherein the lubricator further includes:

a coiled tubing tool having a detachable connector adapted to detachably engage the coiled tubing distal end to form a tool string prior to insertion into the installation;

a seal adapted to isolate the guide from installation fluids and fluid pressures; and a blowout preventer adapted to prevent a blowout.

27. The system of claim 24, further comprising:

a guide spool mounted on the vessel upon which the guide is spooled; and a coiled tubing spool mounted on the vessel upon which the coiled tubing is spooled.

28. The system of claim 24, wherein the vessel further including:

a spool mounted on the vessel upon which a length of the guide is spooled sufficient for the guide to assume a compliant shape between the injector apparatus and the installation and a length of coiled tubing extending from the distal end of the guide out past the proximal end of the guide a sufficient amount to allow the coiled tubing to be inserted into the installation through the guide to a desired position within the installation.

29. The system of claim 24, wherein the installation comprises an oil and/or gas well.

30. The system of claim 24, further comprising an umbilical adapted to allow control from the vessel of controllable functions associated with the installation, the lubricator and the guide.

31. The system of claim 24, further comprising a winch adapted to lower the lubricator to the installation.

* * * * *